US008996365B2

(12) United States Patent
Yamaguchi

(10) Patent No.: US 8,996,365 B2
(45) Date of Patent: Mar. 31, 2015

(54) HOWLING CANCELLER

(75) Inventor: Akio Yamaguchi, Tokyo (JP)

(73) Assignee: Yugengaisya Cepstrum, Tokyo (JP)

( * ) Notice: Subject to any disclaimer, the term of this patent is extended or adjusted under 35 U.S.C. 154(b) by 454 days.

(21) Appl. No.: 13/257,078

(22) PCT Filed: Mar. 19, 2010

(86) PCT No.: PCT/JP2010/002004
§ 371 (c)(1),
(2), (4) Date: Nov. 23, 2011

(87) PCT Pub. No.: WO2010/106820
PCT Pub. Date: Sep. 23, 2010

(65) Prior Publication Data

US 2012/0059649 A1 Mar. 8, 2012

(30) Foreign Application Priority Data

Mar. 19, 2009 (JP) ..... 2009-068683
Sep. 10, 2009 (JP) ..... 2009-209298

(51) Int. Cl.
*G10L 21/00* (2013.01)
*G10L 21/02* (2013.01)
*H04R 3/02* (2006.01)
(Continued)

(52) U.S. Cl.
CPC ..... *H04R 3/02* (2013.01); *G10L 21/0208* (2013.01); *H04R 27/00* (2013.01)
USPC ..... 704/226; 704/225; 704/227; 704/228

(58) Field of Classification Search
CPC ..... G10L 21/0208
USPC ..... 704/225–228
See application file for complete search history.

(56) References Cited

U.S. PATENT DOCUMENTS 5,014,294 A * 5/1991 Kromenaker et al. ..... 455/570
5,442,712 A * 8/1995 Kawamura et al. ..... 381/83
(Continued)

FOREIGN PATENT DOCUMENTS

EP 642230 A1 * 3/1995 ..... H04B 3/23
JP 08-129388 A 5/1996
(Continued)

OTHER PUBLICATIONS

Extended European Search Report dated Aug. 5, 2013 for EP application No. 10753315.0.

*Primary Examiner* — Richemond Dorvil
*Assistant Examiner* — Michael Ortiz Sanchez
(74) *Attorney, Agent, or Firm* — Brundidge & Stanger, P.C.

(57) ABSTRACT

A howling canceller which suppresses occurrence of howling even when an open loop gain exceeds "1" in the whole reproduction band. In the howling canceller, an adaptive filter (107) operates a digital received voice signal with a tap coefficient to generate a pseudo echo; a subtractor (108) subtracts the pseudo echo from a digital transmitted voice signal to generate a residual signal; and an amplitude limiting circuit (110) limits the absolute value of the amplitude of the digital received voice signal to be equal to or smaller than a predetermined threshold which ensures that all of a D/A converter (101), a power amplifier (102), a speaker (103), a microphone (104), a microphone amplifier (105), and an A/D converter (106) operate in a linear operation area, and outputs the amplitude-limited digital received voice signal to the D/A converter (101) and the adaptive filter (107).

6 Claims, 17 Drawing Sheets

(51) Int. Cl.
*G10L 21/0208* (2013.01)
*H04R 27/00* (2006.01)

(56) References Cited

U.S. PATENT DOCUMENTS

| | | | | |
|---|---|---|---|---|
| 5,680,450 | A * | 10/1997 | Dent et al. | 379/406.08 |
| 6,516,050 | B1 * | 2/2003 | Tasaki et al. | 379/3 |
| 6,647,123 | B2 * | 11/2003 | Kandel et al. | 381/318 |
| 7,840,014 | B2 * | 11/2010 | Asakawa | 381/94.1 |
| 8,452,019 | B1 * | 5/2013 | Fomin et al. | 381/58 |
| 8,503,669 | B2 * | 8/2013 | Mao | 379/406.06 |
| 2002/0154761 | A1 * | 10/2002 | McLaughlin et al. | 379/388.01 |
| 2004/0059571 | A1 * | 3/2004 | Ohtomo | 704/226 |
| 2004/0170271 | A1 | 9/2004 | Kubota | |
| 2005/0220313 | A1 * | 10/2005 | Tohyama et al. | 381/98 |
| 2007/0033029 | A1 * | 2/2007 | Sakawaki | 704/233 |
| 2007/0206817 | A1 | 9/2007 | Sakuraba et al. | |
| 2008/0021703 | A1 * | 1/2008 | Kawamura et al. | 704/226 |

FOREIGN PATENT DOCUMENTS

| | | | |
|---|---|---|---|
| JP | 09-168195 | A | 6/1997 |
| JP | 2001-086585 | A | 3/2001 |
| JP | 2006-217542 | A | 8/2006 |
| JP | 2006-261967 | A | 9/2006 |
| JP | 2007-235770 | A | 9/2007 |
| JP | 2008-197438 | A | 8/2008 |
| WO | 94/09604 | A1 | 4/1994 |
| WO | 98/30009 | A2 | 7/1998 |
| WO | 2004/107724 | A2 | 12/2004 |

* cited by examiner

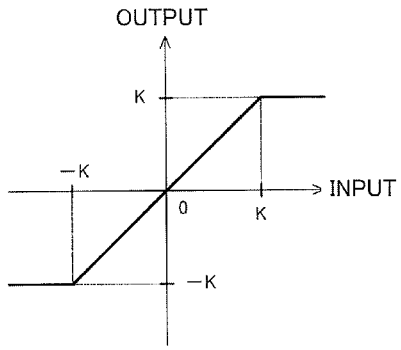
FIG.5A
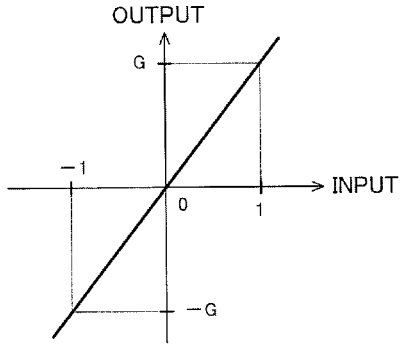
FIG.5B
| | $K_{DA}$ | $G_{DA}$ | $K_{PA}$ | $G_{PA}$ | $K_{SP}$ | $G_{SP}$ | $G_{AC}$ | $K_{MIC}$ | $G_{MIC}$ | $K_{MA}$ | $G_{MA}$ | $K_{AD}$ | $G_{AD}$ |
|---|---|---|---|---|---|---|---|---|---|---|---|---|---|
| CONDITION A | 1 | 10 | 10 | 10 | 100 | 0.1 | 0.1 | 1 | 10 | 10 | 10 | 100 | 10 |
| CONDITION B | 1 | 10 | 10 | 10 | 10 | 0.1 | 0.1 | 1 | 10 | 10 | 10 | 100 | 10 |
| CONDITION C | 1 | 10 | 10 | 10 | 100 | 0.1 | 0.1 | 1 | 100 | 10 | 1 | 100 | 10 |
FIG.6
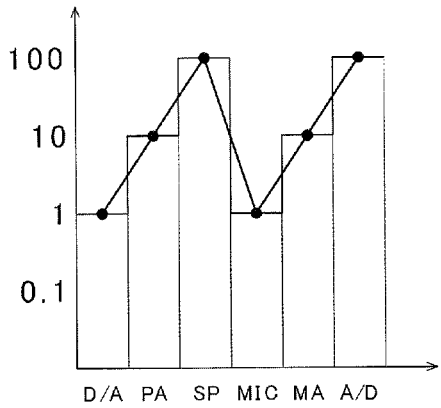
FIG.7

HOWLING CANCELLER

CROSS-REFERENCE TO PRIOR FILED APPLICATIONS:

This is a National Phase Application filed under 35 U.S.C. §371 as a national stage of International Application No. PCT/JP2010/002004, filed on Mar. 19, 2010, claiming the benefit from Japanese Application 2009-068683, filed on Mar. 19, 2009, and claiming the benefit from Japanese Patent Application 2009-209298, filed on Sep. 10, 2009, the content of each of which is hereby incorporated by reference in its entirety.

TECHNICAL FIELD

The present invention relates to a howling canceller for suppressing howling of a speech signal using an adaptive filter.

BACKGROUND ART

Conventionally, there has been disclosed various howling cancellers capable of suppressing howling of a speech signal input from a microphone and emitting the resultant through a speaker and so forth.

A conventional howling canceller based on analog processing without using an adaptive filter has been disclosed in Patent literature 1. Patent literature 1 discloses a technology that assumes transmission characteristics of an acoustic system between a microphone of a hearing aid and a speaker are constant, and prevents the occurrence of howling by setting transmission characteristics of a feedback circuit to be equal to transmission characteristics of the acoustic system, which has been measured in advance, by using the feedback circuit with fixed characteristics. However, if a change occurs in the transmission characteristics of the acoustic system between the microphone and the speaker, it is difficult to suppress the howling with the technology disclosed in Patent literature 1.

In order to cope with the problem of the change in the transmission characteristics of the acoustic system, there has been disclosed a system capable of suppressing howling through digital processing using an adaptive filter in a loudspeaker. The system has a structure in which positive feedback is applied from the output to the input of an adaptive system having the same configuration as the system. In addition, a delay circuit is inserted into a feedback loop. The delay circuit improves convergence characteristics of the adaptive filter by reducing correlation between the output signal and the input signal of the adaptive system, which is caused by feedback.

If delay of the delay circuit is larger than an impulse response length of the system to be identified and disposed between the input of a D/A converter and the output of an A/D converter, and than an impulse response length of the adaptive filter, no increase of the correlation due to the feedback occur in principle.

In this system, even when howling occurs, if the adaptive filter can accurately estimate transmission characteristics between the input of the D/A converter and the output of the A/D converter, the howling can be suppressed.

However, when a gain of a loudspeaker system exceeds "1" in a wide frequency range, convergence of the adaptive filter does not catch up the rapid growth of the amplitude of howling sound caused by positive feedback, the amplitude of the howling sound increases beyond the linear region of any one of a D/A converter, a power amplifier, a speaker, a microphone, a microphone amplifier, and an A/D converter, and the waveform of the howling sound is saturated, resulting in the occurrence of non-linear distortion.

Since the adaptive filter performs a process based on the assumption of the linearity of a system, if non-linear distortion occurs in the progress of generating a desired signal to be estimated from an input signal, bias occurs in the operation of the adaptive filter and thus good convergence characteristics are not obtained. Therefore, if howling occurs in the loudspeaker system with a gain exceeding "1" over a wide frequency range and reaches a saturation state once, it is difficult to suppress the howling by the adaptive filter.

In order to solve the problem, Patent literature 2 discloses a technology capable of preventing saturation of an A/D converter and a D/A converter by using a limiter circuit in an active noise canceller using an adaptive filter.

Furthermore, Patent literature 3 discloses a technology capable of correcting and removing non-linear distortion by using the Volterra filter in order to prevent an adverse influence of the non-linear distortion occurring in a speaker, on the convergence characteristics of a howling canceller.

Furthermore, Patent literature 4 discloses a technology capable of achieving an effect similar to a change in transmission characteristics through a conversion process of a non-linear signal, and suppressing the rapid growth of howling.

CITATION LIST

Patent Literature

PTL 1
Japanese Patent Application Laid-Open No. 9-168195
PTL 2
Japanese Patent Application Laid-Open No. 8-129388
PTL 3
Japanese Patent Application Laid-Open No. 2001-86585
PTL 4
Japanese Patent Application Laid-Open No. 2006-261967

SUMMARY OF INVENTION

Technical Problem

However, in Patent literature 2, the limiter circuit is used only in order to prevent the saturation of the A/D converter and the D/A converter, and it is not ensured that a speaker and a microphone operates in a linear region without being saturated.

Furthermore, in the Volterra filter disclosed in Patent literature 3, rapid saturation characteristics of the D/A converter and the A/D converter are not improved, and an operation with linearity is not ensured regardless of values of the amplitude of an input signal.

Furthermore, the technique disclosed in Patent literature 4 does not ensure that all of the D/A converter, the power amplifier, the speaker, the microphone, the microphone amplifier, and the A/D converter operate in a linear region although grown howling reaches a saturation state.

As described above, in the conventional technologies using the adaptive filter, it is difficult to suppress howling grown in the system with an open loop gain exceeding "1" in the wide frequency range and reached the saturation state.

Furthermore, in the conventional technologies, if the howling occurs and the amplitude of the howling sound is rapidly grown, the non-linear distortion occurs beyond the linear region of any one of the D/A converter, the power amplifier, the speaker, the microphone, the microphone amplifier, and the A/D converter.

Therefore, since the convergence characteristics of the adaptive filter performing a process based on the assumption of the linearity of a system are distorted, it is difficult to suppress the howling having reached the saturation state once by using the adaptive filter.

As described above, in the conventional technologies, a howling suppression effect is achieved only in the state in which the growth of the amplitude of the howling sound is delayed to the extent that the open loop gain has slightly exceeded "1," or when the open loop gain changes before and after the value 1, and it is difficult to suppress howling having occurred due to the fact that the open loop gain exceeds "1" in the whole playback band of the loudspeaker, and reached the saturation state.

In view of the above-described problems, it is therefore an object of the present invention to provide a howling canceller using an adaptive filter, which is capable of suppressing the occurrence of howling even when an open loop gain exceeds "1" in the whole playback band.

Solution to Problem

The howling canceller according to the present invention, which is mounted in an apparatus including a D/A converter that converts a digital received speech signal into an analog received speech signal, a power amplifier that amplifies the analog received speech signal output from the D/A converter, a speaker that plays back the analog received speech signal amplified by the power amplifier and outputs sound, a microphone that converts sound including playback sound output from the speaker into an analog transmitted speech signal, a microphone amplifier that amplifies the analog transmitted speech signal output from the microphone, and an A/D converter that converts the analog transmitted speech signal amplified by the microphone amplifier into a digital transmitted speech signal, includes: an adaptive filter that operates the digital received speech signal with a tap coefficient to generate a pseudo echo, and updates the tap coefficient such that a residual signal is an optimal value; a subtractor that subtracts the pseudo echo from the digital transmitted speech signal to generate the residual signal; and an amplitude limiting circuit that limits an absolute value of an amplitude of the digital received speech signal to be equal to or smaller than a predetermined threshold value, and outputs the amplitude-limited digital received speech signal to the D/A converter and the adaptive filter, wherein the threshold value is a minimum value of a first threshold value set in a linear region of the D/A converter, a second threshold value set in a linear region of the power amplifier, a third threshold value set in a linear region of the speaker, a fourth threshold value set in a linear region of the microphone, a fifth threshold value set in a linear region of the microphone amplifier, and a sixth threshold value set in a linear region of the A/D converter.

Advantageous Effects of Invention

According to the present invention, an amplitude limiting circuit for limiting the amplitude of an input signal of an adaptive filter to be equal to or smaller than a predetermined threshold value is inserted into a feedback loop from the output to the input of a system to be identified. Furthermore, even when howling is grown in the state which an open loop gain of a loudspeaker system is equal to or larger than "1," the threshold value of the amplitude limiting circuit is set such that all of a A/D converter, a power amplifier, a speaker, a microphone, a microphone amplifier, and an A/D converter operate in a linear region without being saturated.

In addition, it is possible to prevent the occurrence of non-linear distortion in an adaptive system having the same configuration as the system, and to also prevent bias of the adaptive system, which is caused by the non-linear distortion. Consequently, even when an open loop gain exceeds "1" in the whole playback band, it is possible to suppress howling.

BRIEF DESCRIPTION OF DRAWINGS

FIG. 5 is a diagram showing input/output characteristics of a non-linear system NL and a linear system L;

FIG. 6 is a diagram showing an example in which a tolerable input signal level and a gain parameter of each unit shown in FIG. 4 are set according to predetermined conditions;

FIG. 7 is a diagram showing a tolerable input signal level and a maximum input signal level of each unit according to a conventional art and Embodiment 1 of the invention under condition A of FIG. 6;

DESCRIPTION OF EMBODIMENTS

Now, embodiments of the present invention will be described in detail with reference to the accompanying drawings.

(Embodiment 1)

Figure 1:
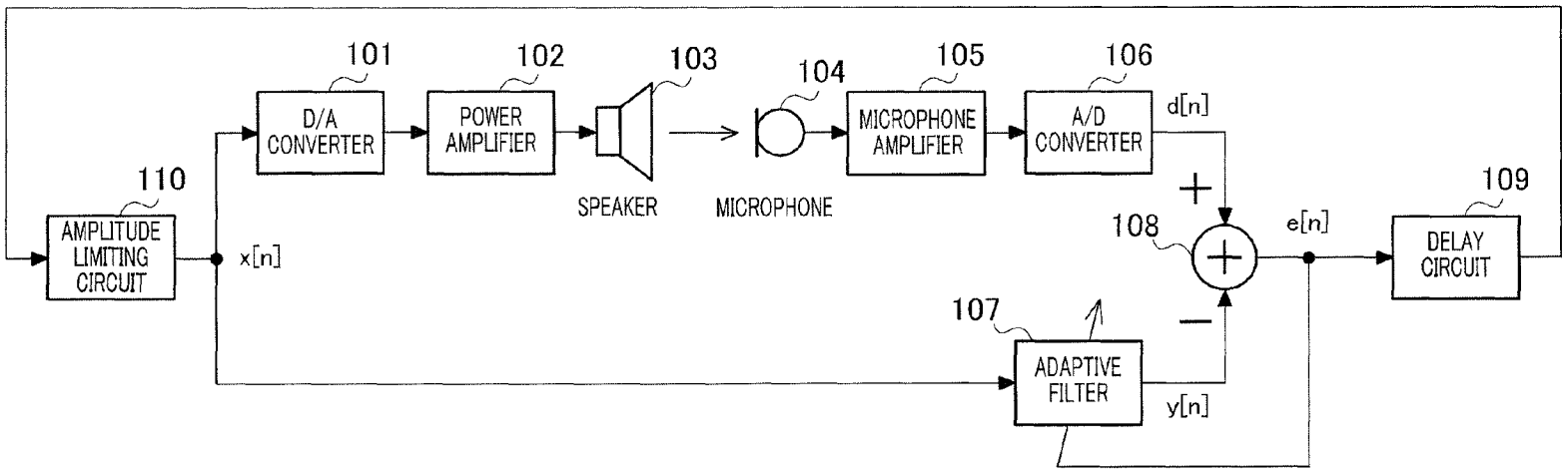
FIG. 1 is a block diagram showing a configuration of a loudspeaker having a howling canceller therein according to Embodiment 1 of the present invention.

FIG. 1 is a block diagram showing a configuration of a loudspeaker according to Embodiment 1 of the present invention.

As shown in FIG. 1, the loudspeaker includes digital-to-analog (D/A) converter 101, power amplifier 102, speaker 103, microphone 104, microphone amplifier 105, analog-to-digital (A/D) converter 106, adaptive filter 107, subtractor 108, delay circuit 109, and amplitude limiting circuit 110.

D/A converter 101 converts a digital received speech signal x[n] at the discrete time n into an analog received speech signal. The analog received speech signal output from D/A converter 101 is amplified by power amplifier 102.

Speaker 103 plays back the analog received speech signal output from power amplifier 102 and outputs sound. The playback sound output from speaker 103 is input to microphone 104.

Microphone 104 converts sound including the playback sound output from speaker 103 into an analog transmitted speech signal. The analog transmitted speech signal output from microphone 104 is amplified by microphone amplifier 105, and is input to A/D converter 106. In addition, when describing the operation of a howling canceller, since a speech signal may be considered to be the same as noise in an amplifier (power amplifier 102 and microphone amplifier 105) and indoor background noise, which become an excitation signal of howling in a silent time, FIG. 1 does not show a speech signal of a person which is input from microphone 104.

A/D converter 106 converts the analog transmitted speech signal into a digital transmitted speech signal d[n]. Digital transmitted speech signal d[n] is input to subtractor 108.

Adaptive filter 107 computes a digital received speech signal x [n] by tap coefficient H[n] so as to generate pseudo echo y[n]. Furthermore, adaptive filter 107 updates tap coefficient H[n] such that residual signal e[n] output from subtractor 108 is an optimal value. In general, adaptive filter 107 has a finite impulse response (FIR) configuration. However, adaptive filter 107 may have an infinite impulse response (IIR) configuration. In the case of using adaptive filter 107 with the IIR configuration, the entire system between digital received speech signal x[n], which is an input signal of an adaptive system, and residual signal e[n], which is an output signal of an adaptive system, may operate as an adaptive notch filter. A system with such an adaptive notch is effective to suppress howling of a system with a gain significantly exceeding "1" at a specific frequency. Furthermore, as an adaptive algorithm of adaptive filter 107, an Least Mean Square (LMS) algorithm, an Normalized LMS (NLMS) algorithm, a projection method, an Recursive Least Square (RLS) algorithm and so forth are generally used. These algorithms are adaptive algorithms that allow an iterative operation to be performed whenever a sampled value of a new signal is input and a tap coefficient to be gradually converged to an optimal value.

Subtractor 108 subtracts pseudo echo y[n] from digital transmitted speech signal d[n] to generate echo-suppressed residual signal e[n].

Delay circuit 109 delays residual signal e[n], which is the output signal of the adaptive system due to feedback, for a predetermined time, and outputs a delayed signal. The output signal of delay circuit 109 is digital received speech signal x[n] which is the input signal of the adaptive system. A delay time in delay circuit 109 is allowed to be the same as an impulse response length of an acoustic system between speaker 103 and microphone 104, so that it is possible to improve the convergence characteristics of adaptive filter 107.

Amplitude limiting circuit 110 limits an absolute value of the amplitude of input signal x[n] of the adaptive system to be equal to or smaller than a predetermined threshold value K. In detail, if the absolute value of the amplitude of input signal x[n] is equal to or smaller than threshold value k, amplitude limiting circuit 110 operates in a linear region to output input signal x[n] as is. If the absolute value of input signal x[n] is larger than threshold value k, a non-linear movement is performed so as to restrict the amplitude of input signal x[n] to be −K or K and then to output input signal x[n].

In addition, as amplitude limiting circuit 110, a simple limiter circuit may be used or a compressor circuit with a time constant may be used. The compressor circuit is an amplifier that calculates short-time mean power (or short-time mean of an absolute value of an amplitude) of an input signal, and controls a gain using the calculated value. The compressor circuit adjusts an output amplitude according to the short-time mean power or the short-time mean of the absolute value of the amplitude of the input signal, thereby reducing the distortion of a waveform caused by amplitude control, as compared with a limiter circuit that instantaneously saturates a waveform.

Threshold value k of amplitude limiting circuit 110 ensures that all of D/A converter 101, power amplifier 102, speaker 103, microphone 104, microphone amplifier 105, and A/D converter 106 operate in the linear region without being saturated.

In this way, if all of D/A converter 101, power amplifier 102, speaker 103, microphone 104, microphone amplifier 105, and A/D converter 106 operate in the linear region, even when howling occurs once, adaptive filter 107 converges and the howling is suppressed.

Figure 2:
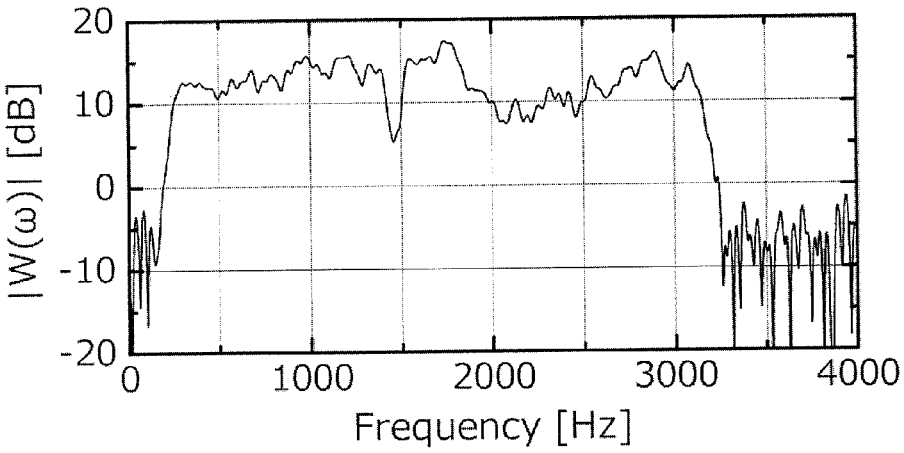
FIG. 2 is a diagram showing open loop frequency characteristics of a loudspeaker system according to Embodiment 1 of the invention.

According to the invention, a howling suppression experiment was performed in an anechoic room in order to verify that howling suppression is actually possible. In this experiment, the distance between speaker 103 and microphone 104 is 2 m. FIG. 2 shows open loop frequency characteristics of a loudspeaker system between the input of D/A converter 101 including transmission characteristics of an acoustic system and the output of A/D converter 106. As apparent from FIG. 2, a loudspeaker has a gain of 0 dB or more, about an average 10 dB, in the whole speech band of about 300 Hz to about 3200 Hz. In addition, in this experiment, a sampling frequency of a howling canceller was set to 8 kHz and the NLMS algorithm was used as the adaptive algorithm.

Figure 3:
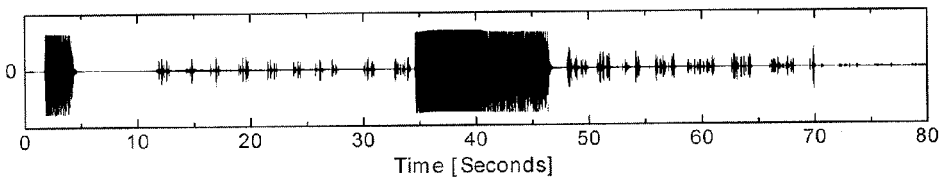
FIG. 3 is diagram showing the level of an output signal of a microphone during the operation of a loudspeaker having a howling canceller therein according to Embodiment 1 of the invention.

FIG. 3 is diagram showing the level of an output signal of a microphone during the operation of a loudspeaker having a howling canceller therein. In FIG. 3, the horizontal axis denotes time (unit: second) and the vertical axis denotes amplitude.

The loudspeaker system and the howling canceller start to operate from the time of two seconds on the time axis of FIG. 3. At this time, sound is not input from microphone 104. However, noise in power amplifier 102 and microphone amplifier 105 or background noise in an anechoic room becomes an excitation signal, resulting in the immediate occurrence of howling.

In a start period (for a little while after the system starts operating), since the convergence of the adaptive algorithm does not catch up the growth of the amplitude of howling sound, the howling sound is directly saturated. In such a state, since the amplitude of a signal is limited by amplitude limiting circuit 110, even when howling occurs, all of D/A converter 101, power amplifier 102, speaker 103, microphone 104, microphone amplifier 105, and A/D converter 106 operate in the linear region.

Adaptive filter 107 gradually converges even while howling with a saturated amplitude in amplitude limiting circuit 110 is being continued, and the howling is suppressed at the time of five seconds.

Voice is input to microphone 104 from the time of 12 seconds. However, a loudspeaking operation is performed in a stable state.

At the time of 34 seconds, the output signal y[n] of adaptive filter 107 is forcedly set to 0 and the howling suppression process is forcedly stopped.

Therefore, howling occurs again. The forced stop of the howling suppression process is for simulating the state, in which the howling suppressed once has occurred again, because the transmission characteristics of the loudspeaker system rapidly change and the convergence of the adaptive filter 107 does not catch up.

Even while the howling is occurring, a coefficient update operation of adaptive filter 107 is continued. However, since the y[n] is forcedly set to 0, residual signal e[n] is equal to d[n] and the coefficient of adaptive filter 107 is diverged to a random value.

At the time of 41 seconds, the operation of forcedly setting the output signal y[n] of adaptive filter 107 to 0 is stopped, and the howling canceller normally operates.

Since the y[n] is forcedly set to 0 and thus the coefficient of adaptive filter 107 is diverged, howling is continued for a little while. However, adaptive filter 107 gradually converges, and the howling is suppressed at the time of 47 seconds. After the howling is suppressed, the loudspeaking operation is normally continued.

The operations of the loudspeaker system and the howling canceller are stopped at the time of 70 seconds, and no output is generated from the speaker of the loudspeaker system. Therefore, after 70 seconds, the amplitude of the speech signal output from microphone 104 is reduced. Consequently, it is possible to check that the loudspeaker system has a loudspeaking gain of 0 dB or more.

As described above, according to the present invention, through the anechoic room experiment, it is verified that it is possible to suppress howling having occurred from the loudspeaker having a gain of 0 dB or more, about an average 10 dB, in the whole speech band of 300 Hz to 3200 Hz.

Furthermore, after suppressing howling having occurred in the start period, robustness of an operation capable of suppressing howling having occurred again due to a change and so forth in the transmission characteristics of the acoustic system is also verified.

(Embodiment 2)

In Embodiment 2, a method for setting threshold value k of amplitude limiting circuit 110 shown in FIG. 1 will be described.

Figure 4:
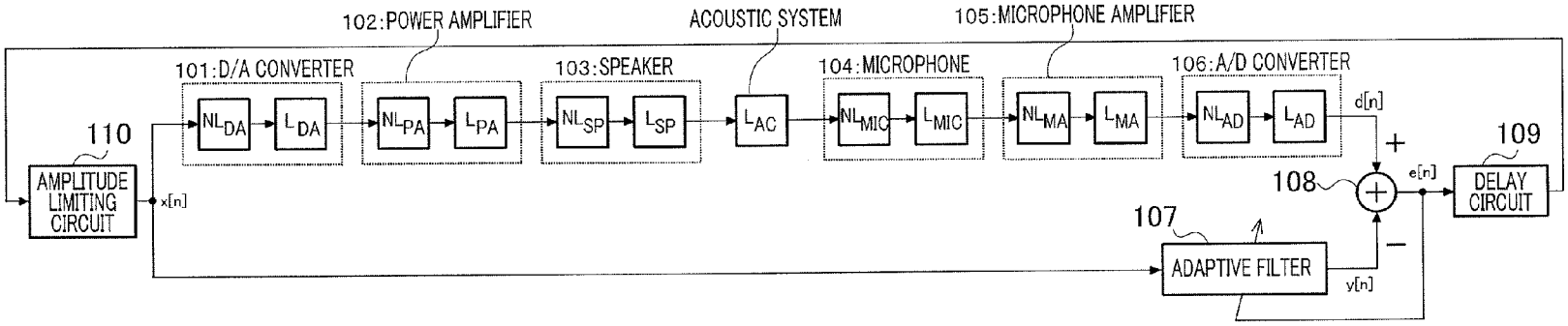
FIG. 4 is a diagram showing in detail the characteristics of each element of the loudspeaker of FIG. 1.

FIG. 4 is a diagram showing in detail the characteristics of each element of the loudspeaker of FIG. 1. In addition, FIG. 4 shows a model in which each of power amplifier 102, speaker 103, the acoustic system between speaker 103 and microphone 104, microphone 104, and microphone amplifier 105 has flat frequency characteristics.

In the model of FIG. 4, each of D/A converter 101 with non-linearity, power amplifier 102, speaker 103, microphone 104, microphone amplifier 105, and A/D converter 106 connects a non-linear system NL to a linear system L.

The non-linear system NL has input/output characteristics shown in FIG. 5A. In a linear region where an absolute value of the amplitude of an input signal is equal to or smaller than threshold value k, a gain of the non-linear system NL is "1" and output of the non-linear system NL is not saturated. In a non-linear region where the absolute value of the amplitude of the input signal is equal to or higher than threshold value k, the output of the non-linear system NL is saturated. Furthermore, the linear system L has input/output characteristics shown in FIG. 5B and a gain G.

In FIG. 4, $NL_{DA}$, $NL_{PA}$, $NL_{SP}$, $NL_{MIC}$, $NL_{MA}$, and $NL_{AD}$ represent the characteristics of non-linear system parts of D/A converter 101, power amplifier 102, speaker 103, microphone 104, microphone amplifier 105, and A/D converter 106, respectively. Furthermore, in FIG. 4, $L_{DA}$, $L_{PA}$, $L_{SP}$, $L_{AC}$, $L_{MIC}$, $L_{MA}$, and $L_{AD}$ represent the characteristics of linear system parts of D/A converter 101, power amplifier 102, speaker 103, the acoustic system between speaker 103 and microphone 104, microphone 104, microphone amplifier 105, and A/D converter 106, respectively. In addition, the acoustic system is linear and does not have non-linear characteristics.

Here, $K_{DA}$, $K_{PA}$, $K_{SP}$, $K_{MIC}$, $K_{MA}$, and $K_{AD}$ are set as tolerable input signal levels of the non-linear system parts of D/A converter 101, power amplifier 102, speaker 103, microphone 104, microphone amplifier 105, and A/D converter 106, respectively.

Furthermore, $G_{DA}$, $G_{PA}$, $G_{SP}$, $G_{AC}$, $G_{MIC}$, $G_{MA}$, and $G_{AD}$ are set as gains of the linear system parts of D/A converter 101, power amplifier 102, speaker 103, the acoustic system between speaker 103 and microphone 104, microphone 104, microphone amplifier 105, and A/D converter 106, respectively.

At this time, an open loop gain $G_{ALL}$ of the entire loudspeaker is expressed by equation 1 below.

[1]

$$G_{ALL}=G_{DA}\cdot G_{PA}\cdot G_{SP}\cdot G_{AC}\cdot G_{MIC}\cdot G_{MA}\cdot G_{AD} \quad \text{Equation 1}$$

In equation 1, if $1<G_{ALL}$, even when no speech signal is input from microphone 104, howling occurs immediately after the system starts operating because indoor background noise or noise occurring in power amplifier 102 and microphone amplifier 105 becomes an excitation signal.

In order to suppress howling using adaptive filter 107 based on the assumption of the linearity of a system, all elements of the loudspeaker should be linear. In order to ensure that all of D/A converter 101, power amplifier 102, speaker 103, microphone 104, microphone amplifier 105, and A/D converter 106 always operate in the linear region without being saturated, threshold value k of amplitude limiting circuit 110 should satisfy all of conditional equation 2 below.

[2]

$$K \le K_{DA}$$

$$K \cdot G_{DA} \le K_{PA}$$

$$K \cdot G_{DA} \cdot G_{PA} \le K_{SP}$$

$$K \cdot G_{DA} \cdot G_{PA} \cdot G_{SP} \cdot G_{AC} \le K_{MIC}$$

$$K \cdot G_{DA} \cdot G_{PA} \cdot G_{SP} \cdot G_{AC} \cdot G_{MIC} \le K_{MA}$$

$$K \cdot G_{DA} \cdot G_{PA} \cdot G_{SP} \cdot G_{AC} \cdot G_{MIC} \cdot G_{MA} \le K_{AD} \quad \text{Equation 2}$$

Threshold value k of amplitude limiting circuit 110 satisfying all of the above-mentioned limiting conditions and ensuring that all of D/A converter 101, power amplifier 102, speaker 103, microphone 104, microphone amplifier 105, and A/D converter 106 operate in the linear region is calculated by equation 3 below. In equation 3, a function min( ) is for calculating a minimum value of arguments. Furthermore, $K_1$ denotes a threshold value (e.g. a maximum value of a linear region of D/A converter 101) set in the linear region of D/A converter 101, $K_2$ denotes a threshold value (e.g. a maximum value of a linear region of power amplifier 102) set in the linear region of power amplifier 102, $K_3$ denotes a threshold value (e.g. a maximum value of a linear region of speaker 103) set in the linear region of speaker 103, $K_4$ denotes a threshold value (e.g. a maximum value of a linear region of microphone 104) set in the linear region of microphone 104, $K_5$ denotes a threshold value (e.g. a maximum value of a linear region of microphone amplifier 105) set in the linear region of microphone amplifier 105, and $K_6$ denotes a threshold value (e.g. a maximum value of a linear region of A/D converter 106) set in the linear region of A/D converter 106.

[3]

$$K_1 = K_{DA} \quad \text{Equation 3}$$

$$K_2 = \frac{K_{PA}}{G_{DA}}$$

$$K_3 = \frac{K_{SP}}{G_{DA} \cdot G_{PA}}$$

$$K_4 = \frac{K_{MIC}}{G_{DA} \cdot G_{PA} \cdot G_{SP} \cdot G_{AC}}$$

$$K_5 = \frac{K_{MA}}{G_{DA} \cdot G_{PA} \cdot G_{SP} \cdot G_{AC} \cdot G_{MIC}}$$

$$K_6 = \frac{K_{AD}}{G_{DA} \cdot G_{PA} \cdot G_{SP} \cdot G_{AC} \cdot G_{MIC} \cdot G_{MA}}$$

$$K = \min(K_1, K_2, K_3, K_4, K_5, K_6)$$

The tolerable input signal levels $K_{DA}$, $K_{PA}$, $K_{SP}$, $K_{MIC}$, $K_{MA}$, and $K_{AD}$ and the gains $G_{DA}$, $G_{PA}$, $G_{SP}$, $G_{AC}$, $G_{MIC}$, $G_{MA}$, and $G_{AD}$ of equation 3 can be obtained from parameters and actually measured data which are written in specifications, an instruction manual and so forth of an apparatus.

Now, a method for calculating these values will be described in detail.

Tolerable input signal level $K_{DA}$ of D/A converter 101 can be obtained from a resolution thereof. For example, if an input signal format of D/A converter 101 is a complement of 2 and a resolution is 65536 steps, since an input signal range is −32768 to 32768, $K_{DA}$ is 32767.

The conversion gain $G_{DA}$ of D/A converter 101 is defined as a variation of an output voltage when an input signal of D/A converter 101 is changed by 1 step, and can be obtained by the resolution and the output voltage range of D/A converter 101. For example, the conversion gain $G_{DA}$ of D/A converter 101 with the resolution of 65536 steps and the output voltage range of −5 V to 5 V is 0.000152587 V (=(5−(−5))/65536).

Tolerable input signal level $K_{PA}$ expressed by a peak value of power amplifier 102 can be obtained from gain $G_{PA}$ and an effective maximum output power $P_{PA}$ [W] of power amplifier 102, and impedance $Z_{SP}$ [Ω] of speaker 103, which is connected to power amplifier 102, by equation 4 below. In addition, a unit [$V_{pk}$] of equation 4 represents that a voltage of the $K_{PA}$ is a peak value. When the gain of a power amplifier is not written in specifications or a gain is changed, gain $G_{PA}$ in a use state may be obtained by actual measurement.

[4]

$$K_{PA} = \frac{\sqrt{2 \cdot P_{PA} \cdot Z_{SP}}}{G_{PA}} [V_{pk}] \quad \text{Equation 4}$$

Tolerable input signal level $K_{SP}$ represented by a peak value of speaker 103 can be obtained from an effective tolerable input power $P_{SP}$ [W] and impedance $Z_{SP}$ [Q] of speaker 103 by equation 5 below.

[5]

$$K_{SP} = \sqrt{2 \cdot P_{SP} \cdot Z_{SP}} [V_{pk}] \quad \text{Equation 5}$$

Gain $G_{SP}$ of speaker 103 is defined as sound pressure occurring at the position of a distance 1 m when a signal with a peak value 1 [$V_{pk}$] is input to speaker 103. Gain $G_{SP}$ can obtained from sensitivity $S_{SP}$ [$dB_{SPL}$] and impedance $Z_{SP}$ [Ω] of speaker 103 by equation 6 below.

[6]

$$G_{SP} = 0.00002 \cdot 10^{\frac{S_{SP}}{20}} \cdot \frac{1}{\sqrt{2 \cdot Z_{SP}}} [Pa/V_{pk}] \quad \text{Equation 6}$$

Since sensitivity $S_{SP}$ of speaker is represented by the level of sound pressure occurring at the position of the distance 1 m when a signal with an effective power of 1 W is input to speaker 103, sensitivity $S_{SP}$ is written in the specifications of speaker 103. In the specifications, a catalog and so forth, the $S_{SP}$ may not be written as sensitivity, but an index representing efficiency. In addition, a sound pressure level S [$dB_{SPL}$] and sound pressure P [Pa] have relationship of equation 7.

[7]

$$P = 0.00002 \cdot 10^{\frac{S}{20}} \quad \text{Equation 7}$$

In an open outdoor loudspeaker system with a small echo, an attenuation amount $G_{AC}$ of sound pressure of the acoustic system between speaker 103 and microphone 104 can be obtained from distance $D_{AC}$ [m] between speaker 103 and microphone 104. In the case of a general speaker system, the attenuation amount $G_{AC}$ can be obtained by equation 8 below under the assumption that sound pressure is attenuated by an inverse square law.

[8]

$$G_{AC} = \frac{1}{D_{AC}^2} \quad \text{Equation 8}$$

In the case of using an array-type speaker system, since sound pressure is generally attenuated in proportional to the distance, the attenuation amount $G_{AC}$ can be obtained by equation 9.

[9]

$$G_{AC} = \frac{1}{D_{AC}} \quad \text{Equation 9}$$

In the case of using a large-sized flat speaker system having a large scale diaphragm with respect to the distance between speaker 103 and microphone 104, since distance attenuation is very small, the $G_{AC}$ may be 1.

In the indoor environment with an echo, due to an echo component, actual distance attenuation is small as compared with the attenuation amount $G_{AC}$ obtained by distance $D_{AC}$ between speaker 103 and microphone 104 as described above. In this regard, in the indoor environment where the influence of echo cannot be ignored, it is preferable to obtain the attenuation amount $G_{AC}$ by actual measurement.

A sound pressure level in the nearest position to speaker 103 and a sound pressure level at the position of a diaphragm of microphone 104 are measured using a noise level meter, thereby directly measuring the attenuation amount $G_{AC}$. Otherwise, a gain between an input terminal of power amplifier 102 and an output terminal of microphone amplifier 105 is actually measured, and is divided by $G_{PA} \cdot G_{SP} \cdot G_{MIC} \cdot G_{MA}$, thereby calculating the attenuation amount $G_{AC}$.

Tolerable input signal level $K_{MIC}$ represented by a peak value of microphone 104 can be obtained from maximum input sound pressure level $A_{MIC}$ [$dB_{SPL}$], which is written in the specifications of microphone 104, by equation 10.

[10]

$$K_{MIC} = 0.00002 \cdot 10^{\frac{A_{MIC}}{20}} [PA] \quad \text{Equation 10}$$

In addition, since it is considered that a dynamic-type microphone and so forth have the maximum input sound pressure level exceeding about 120 $dB_{SPL}$, which is the maximum audible field of a person, and are not saturated in a realistic use state, the maximum input sound pressure level may not be written in the specifications. In such a case, tolerable input signal level $K_{MIC}$ may be infinite.

Gain $G_{MIC}$ of microphone 104 is defined as a value obtained by expressing an output voltage when an input sound pressure is 1 [Pa] as a peak value. Gain $G_{MIC}$ can be obtained from sensitivity $S_{MIC}$ [dB], which is written in the specifications of microphone 104, by equation 11.

[11]

$$G_{MIC} = \sqrt{2} \cdot 10^{\frac{SENS_{MIC}}{20}} [V_{pk} / Pa] \quad \text{Equation 11}$$

Sensitivity $S_{MIC}$ [dB] of microphone 104 is obtained by expressing the output voltage when the input sound pressure is 1 Pa as an effective value in the case in which a reference level 0 dB is 1 Vrms.

Tolerable input signal level $K_{MA}$ represented by a peak value of microphone amplifier 105 can be obtained from gain $G_{MA}$ and the effective maximum output voltage $A_{MA}$ [Vrms] of microphone amplifier 105 by equation 12. Gain $G_{MA}$ and the effective maximum output voltage $A_{MA}$ are written in the specifications of microphone amplifier 105. In addition, when gain $G_{MA}$ of microphone amplifier 105 is not written in the specifications or gain $G_{MA}$ is changed, gain $G_{MA}$ in a use state may be obtained by actual measurement.

[12]

$$K_{MA} = \frac{\sqrt{2} \cdot A_{MA}}{G_{MA}} [V_{pk}] \quad \text{Equation 12}$$

Tolerable input signal level $K_{AD}$ of A/D converter 106 is obtained from a convertible input voltage range written in specifications. For example, tolerable input signal level $K_{AD}$ of A/D converter 106, in which the convertible input voltage range is −5V to 5V, is 5 V.

The conversion gain $G_{AD}$ of A/D converter 106 is represented by a variation of an output signal when an input signal of A/D converter has been changed by 1 V. The conversion gain $G_{AD}$ can be obtained from the resolution and the convertible input voltage range of A/D converter 106. For example, the conversion gain $G_{AD}$ of A/D converter 106 with the resolution of 65536 steps and the input voltage range of −5 V to 5 V is 6553.6 [1/V](=65536/(5−(−5))).

In calculating the above-mentioned parameters, parameters such as sensitivity written in the specifications or the instruction manual of speaker 103 and microphone 104 are used. In general, sensitivity characteristics and so forth of speaker 103 and microphone 104 are defined at the frequency of 1 kHz. However, when frequency characteristics are not flat, sensitivity at a frequency, at which a correction value based on a graph of frequency characteristics written in the specifications or the instruction manual is maximal, is obtained, and the parameters are calculated based on the value. Even when frequency characteristics of power amplifier 102 and microphone amplifier 105 are not flat, the frequency characteristics may be corrected in the same manner, and calculation at a frequency, at which a gain is maximal, may be performed.

Next, the operation of the system when the tolerable input signal levels and the gain parameters of the respective units shown in FIG. 4 are set as shown in FIG. 6 will be described. In FIG. 6, the open loop gain $G_{ALL}$ of the loudspeaker system is the same under the conditions A to C.

In the parameter setting under condition A in FIG. 6, a howling canceller having a limiter circuit for preventing the saturation of a D/A converter according to the conventional art is considered. In the conventional art, threshold value k of the limiter circuit (corresponds to amplitude limiting circuit 110 of FIG. 4) for preventing the saturation of the D/A converter is "1."

At this time, the tolerable input signal levels and the maximum input signal levels of the respective units are shown in FIG. 7. In FIG. 7, a stepped graph denotes the tolerable input signal levels and a broken line graph with black circles denotes the maximum input signal levels.

In such a case, in the limiter circuit for preventing the saturation of the D/A converter, since the input signal level of the D/A converter is limited to be equal to or smaller than an absolute value "1," other units also operate in a linear region without being saturated.

Consequently, the howling canceller using an adaptive filter with the same configuration as the system also operates in the linear region, thereby suppressing howling.

Figure 8:
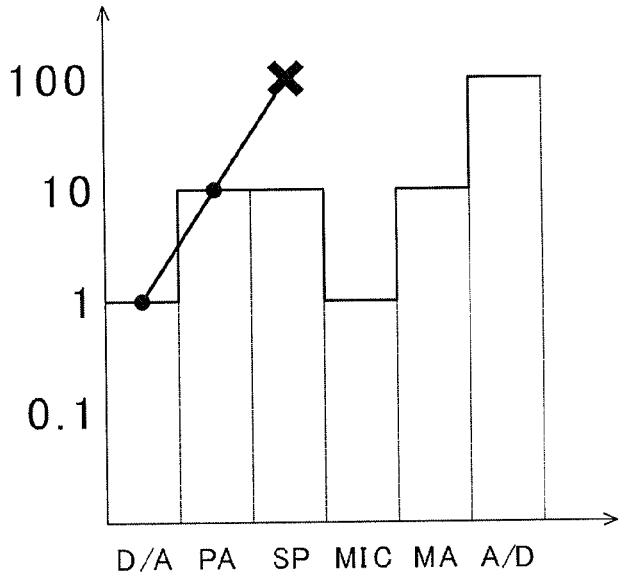
FIG. 8 is a diagram showing a tolerable input signal level and a maximum input signal level of each unit according to a conventional art under condition B of FIG. 6.

However, in the case of condition B, when threshold value k of the amplitude limiting circuit for preventing the saturation of the D/A converter has been set to 1 as with the conventional art, the output signal level of a power amplifier exceeds the tolerable input signal level of a speaker as shown in FIG. 8, and the speaker is saturated, resulting in the occurrence of non-linear distortion.

Therefore, it is difficult to ensure the linear operation of the howling canceller, and hence difficult to ensure the convergence of the adaptive filter, so that it is difficult to suppress howling.

Figure 9:
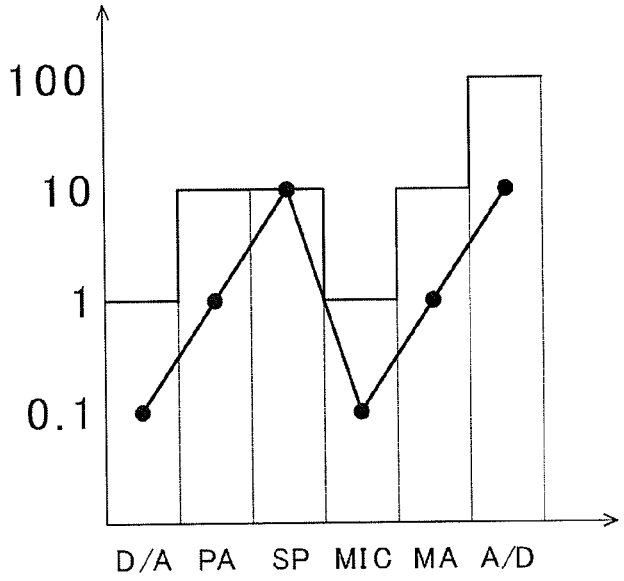
FIG. 9 is a diagram showing a tolerable input signal level and a maximum input signal level according to Embodiment 1 of the invention under condition B of FIG. 6.

Meanwhile, threshold value k obtained by the scheme of the present embodiment is 0.1. In such a case, the tolerable input signal levels and the maximum input signal levels of the respective units are shown in FIG. 9, and it can be understood that it is possible to ensure the linear operation of the howling canceller without the saturation of all units.

Figure 10:
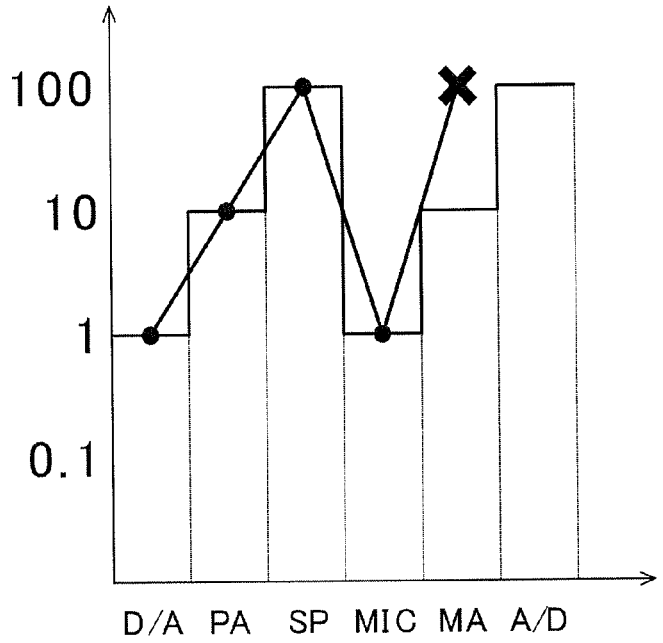
FIG. 10 is a diagram showing a tolerable input signal level and a maximum input signal level of each unit according to a conventional art under the condition C of FIG. 6.

Furthermore, in the case of condition B, when threshold value k of the amplitude limiting circuit for preventing the saturation of the D/A converter has been set to 1 as with the conventional art, the output signal level of a microphone exceeds the tolerable input signal level of a microphone amplifier as shown in FIG. 10, and the microphone amplifier is saturated, resulting in the occurrence of non-linear distortion. Therefore, it is difficult to ensure the linear operation of the howling canceller, and hence difficult to assure the convergence of the adaptive filter, so that it is difficult to suppress howling.

Figure 11:
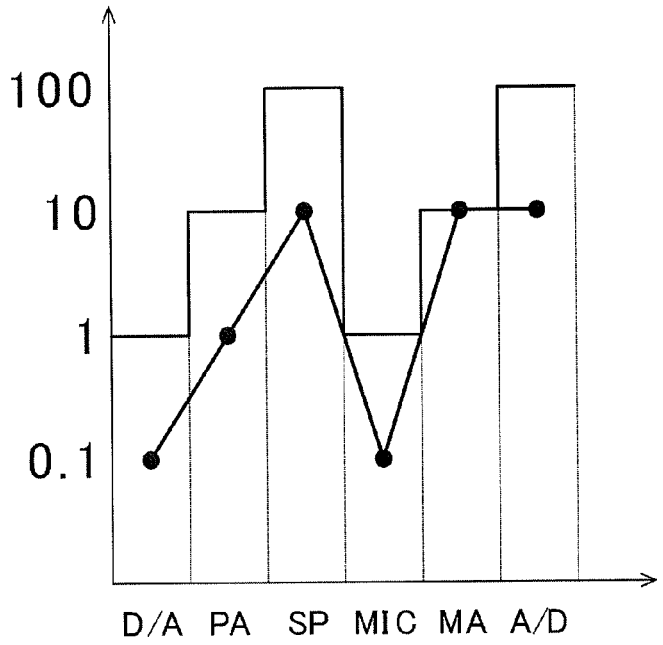
FIG. 11 is a diagram showing a tolerable input signal level and a maximum input signal level according to Embodiment 1 of the invention under the condition C of FIG. 6.

Meanwhile, threshold value k obtained by the scheme of the present embodiment is 0.1. In such a case, the tolerable input signal levels and the maximum input signal levels of the respective units are shown in FIG. 11, and it can be understood that it is possible to ensure the linear operation of the howling canceller without the saturation of all units.

In FIGS. 7 to 11, the [D/A] denotes a D/A converter, the [PA] denotes a power amplifier, the [SP] denotes a speaker, the [MIC] denotes a microphone, the [MA] denotes a microphone amplifier, the [A/D] denotes an A/D converter.

As described above, according to the present embodiment, it is possible to more accurately obtain threshold value k of amplitude limiting circuit 110 achieving a howling suppression effect.

(Embodiment 3)

In Embodiment 3, a case of automatically setting threshold value k while operating the loudspeaker in the state in which howling has actually occurred will be described.

Figure 12:
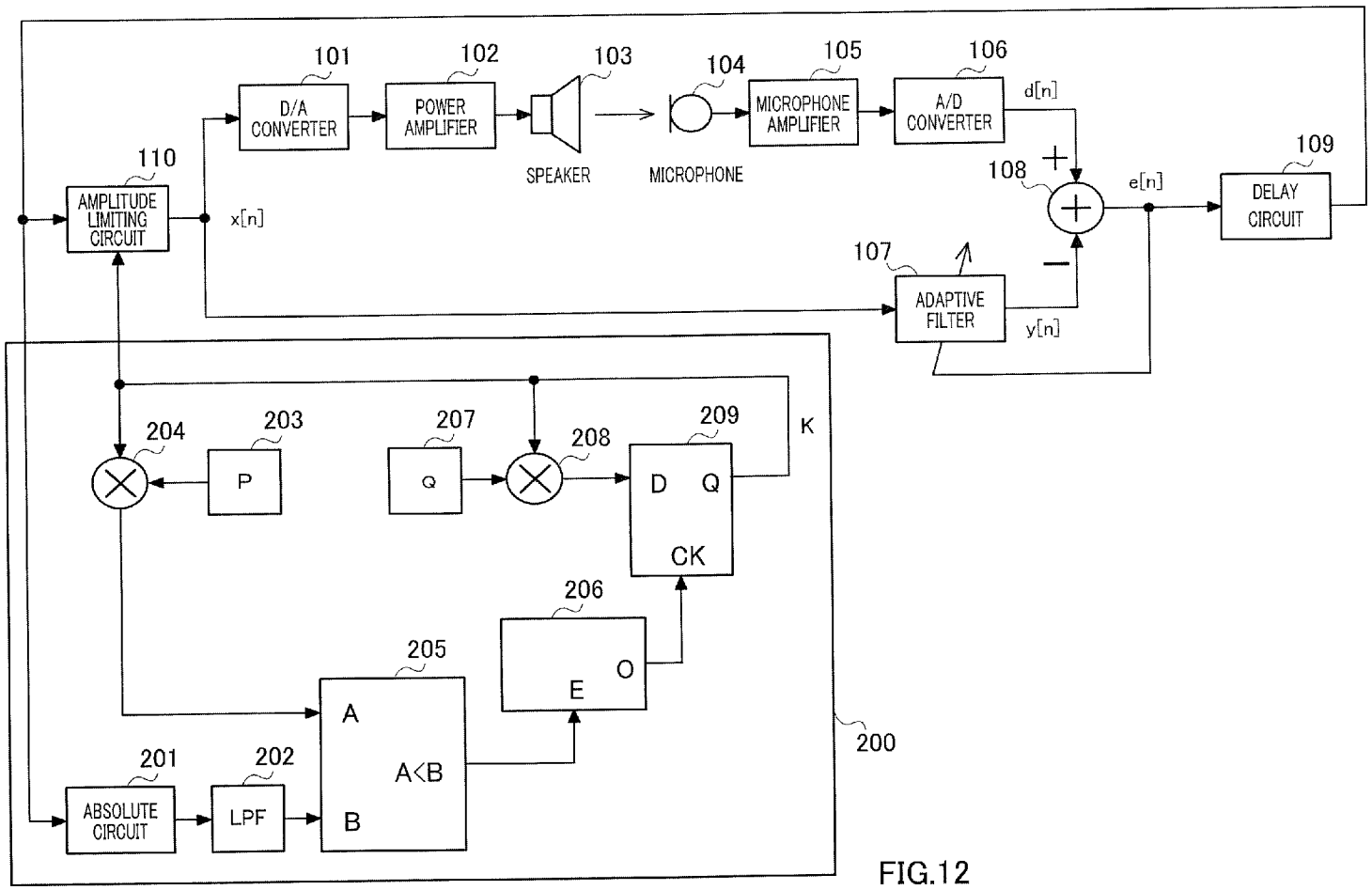
FIG. 12 is a block diagram showing a configuration of a loudspeaker having a howling canceller therein according to Embodiment 3 of the invention.

FIG. 12 is a block diagram showing a configuration of the loudspeaker having the howling canceller therein according to the present embodiment. FIG. 12 shows a configuration in which threshold value setting circuit 200 is further added to the configuration of FIG. 1. Amplitude limiting circuit 110 limits the amplitude of input signal x[n] to be equal to or smaller than threshold value k set by threshold value setting circuit 200.

Threshold value setting circuit 200 includes absolute value circuit 201, Low Pass Filter (LPF) 202, constant generation circuit 203, multiplier 204, magnitude comparator 205, clock generation circuit 206, constant generation circuit 207, multiplier 208, and register 209.

Absolute value circuit 201 full-wave rectifies input signal x[n]. Low Pass Filter (LPF) 202 smoothes the output of absolute value circuit 201.

Constant generation circuit 203 generates a constant P ($0<P<1$) for detecting howling. Usually, the value of constant P may be set to about 0.2 to about 0.5. Multiplier 204 multiplies threshold value k by constant P to calculate value k·P.

Magnitude comparator 205 outputs "0" if a relationship in magnitude between the amplitude of an input signal (an output signal of multiplier 204) of terminal A thereof and the amplitude of an input signal (an output signal of LPF 202) of terminal B thereof satisfies $A \geq B$ while outputting "1" if the magnitude relation satisfies $A<B$. Thus, the output of magnitude comparator 205 is "0" in a howling suppression state, but is "1" in the state in which the amplitude of the output signal of LPF 202 has exceeded the product K·P due to the occurrence of howling.

Clock generation circuit 206 generates a clock signal with a cycle of about 1 second to about 10 seconds to output the clock signal to register 209. In addition, "E" and "O" of clock generation circuit 206 denote a control signal input terminal and an output terminal, respectively. Clock generation circuit 206 generates the clock signal when E=1, stops the output of the clock signal when E=0, and completes the update of threshold value k.

Constant generation circuit 207 generates a constant Q ($0<Q<1$) for detecting howling. Usually, the value of the constant Q may be set to about 0.7 to about 0.5 which correspond to a variation of −3 dB to −6 dB. Multiplier 208 multiplies threshold value k by the constant Q to calculate value k·Q.

Register 209 holds an initial value of threshold value k. If value k·Q is input from multiplier 208, register 209 holds the input value K·Q as a new threshold value K. Then, register 209 outputs the held threshold value K in synchronization with the clock signal input to "CK." In addition, "D," "Q" and "CK" of register 209 denote an input terminal, an output terminal, and a clock input terminal, respectively.

In this way, threshold value k of register 209 is updated in synchronization with the clock signal, so that howling suppression is possible and an optimal threshold value K for allowing the achievement of the maximum output sound pressure level can be automatically set.

In addition, the initial value of threshold value k is set to be the same as the tolerable input signal level of D/A converter 101. For example, if the resolution of D/A converter 101 is 65536 steps and the input signal range is −32768 to 32768, the initial value of threshold value k may be set to 32767.

Now, the operation sequence of threshold value setting circuit 200 will be described.

If the loudspeaker starts operating, when an open loop gain of a loudspeaker system is equal to or higher than "1," since indoor background noise or noise occurring in power amplifier 102 and microphone amplifier 105 becomes an excitation signal and howling immediately occurs, the amplitude of an input signal of amplitude limiting circuit 110 exceeds threshold value k.

A peak value of input signal x[n] of amplitude limiting circuit 110 is detected by absolute value circuit 201 and LPF 202, and is input to magnitude comparator 205.

Magnitude comparator 205 outputs a result obtained by comparing the peak value of input signal x[n] of amplitude limiting circuit 110 with value k·P. If howling occurs, since the peak value of input signal x[n] of amplitude limiting circuit 110 is larger than value k·P, "1" is output from magnitude comparator 205.

An output signal of magnitude comparator 205 is input to the control signal input terminal of clock generation circuit 206, and clock generation circuit 206 continues to output a clock signal while the howling is occurring.

Register 209 continues to update a held threshold value K to a value Q·K while the clock signal is being supplied due to the occurrence of howling.

As described above, during the continuance of howling having occurred directly after the system starts operating, threshold value k of amplitude limiting circuit 110 is gradually reduced. If the value reaches threshold value k at which all of D/A converter 101, power amplifier 102, speaker 103, microphone 104, microphone amplifier 105, and A/D converter 106 operate in a linear region, adaptive filter 107 can converge regardless of the influence of the non-linearity of the loudspeaker system, resulting in the suppression of howling.

Furthermore, if adaptive filter 107 converges and the howling is suppressed, since the input signal of amplitude limiting circuit 110 is "0," the output of magnitude comparator 205 is also "0." As a consequence, since the control signal of clock generation circuit 206 is also "0," the output of the clock signal is stopped and threshold value k held in register 209 is not updated.

As described above, according to the present embodiment, it is possible to suppress howling and automatically obtain threshold value k for allowing the achievement of the maximum sound pressure level of reinforced sound. Furthermore, threshold value k is constant at a value at the time of howling suppression, and even when person's speech is input from microphone 104 later, it is possible to continue a loudspeaking operation while maintaining a howling suppression state. Then, although the transmission characteristics of an acoustic system is suddenly changed, the convergence of adaptive filter 107 does not catch up, and howling occurs again, adaptive filter 107 continues a convergence operation without being affected by non-linearity by amplitude limiting circuit 110, resulting in the suppression of howling.

(Embodiment 4)

When an input signal is a colored signal, convergence characteristics of adaptive filter 107 generally deteriorate as compared with the case in which an input signal is a white signal. Since a person's speech signal is a colored signal, adaptive filter 107 does not achieve ideal convergence characteristics in a howling canceller that processes speech.

In Embodiment 4, the case for solving the above-mentioned problem will be described. In detail, amplitude limiting circuit 110 uses a circuit that replaces input signal x[n] equal to or higher than threshold value k with a signal having an absolute amplitude value equal to threshold value k and random characteristics.

Figure 13:
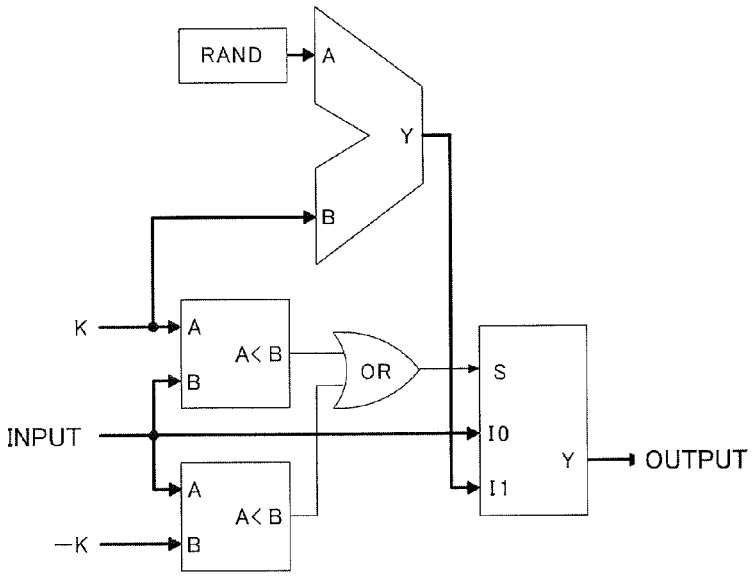
FIG. 13 is a diagram showing a circuit configuration of an amplitude limiting circuit of a howling canceller according to Embodiment 4 of the invention.

FIG. 13 is a diagram showing a circuit configuration of amplitude limiting circuit 110 according to the present embodiment. Meanwhile, FIG. 14 is a diagram showing a circuit configuration when amplitude limiting circuit 110 is formed of a limiter circuit having a magnitude comparator and a multiplexer therein.

Figure 14:
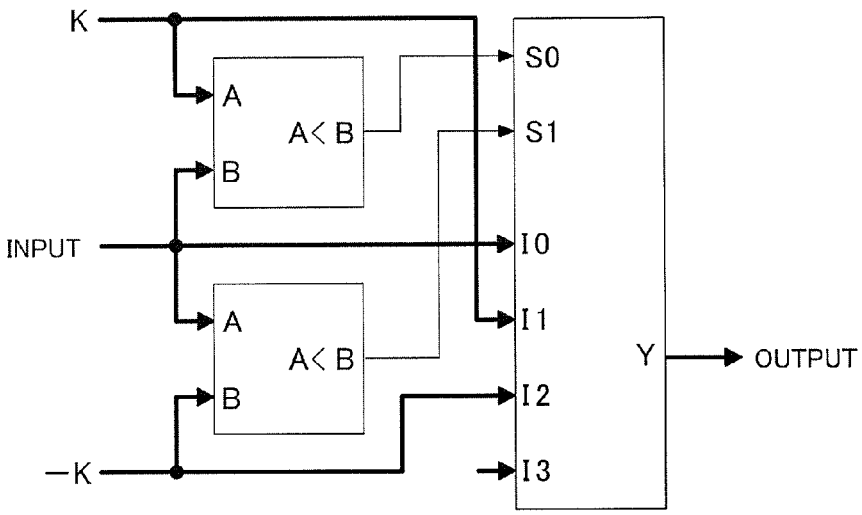
FIG. 14 is a diagram showing a circuit configuration when an amplitude limiting circuit is formed of a limiter circuit having a magnitude comparator and a multiplexer therein.

In FIGS. 13 and 14, a block having input terminals A and B and an output terminal A<B denotes the magnitude comparator.

Furthermore, in FIG. 13, a block having input terminals S, I0 and I1 and an output terminal Y denotes the multiplexer, wherein the S denotes a control signal and the I0 and I1 denote a signal to be selected. The multiplexer outputs a signal input to the terminal I0 when the S is 0 from terminal Y, and outputs a signal input to the terminal I1 when the S is 1 from terminal Y. In addition, in FIG. 13, a block represented by a mark "OR" denotes an OR circuit, and a block having input terminals A and B and an output terminal Y denotes a multiplier. Moreover, in FIG. 13, a block represented by a mark "RAND" denotes a binary pseudo random number generator and generates a pseudo random number with a value "1" or "−1."

Furthermore, in FIG. 14, a block having input terminals S0, S1, and I0 to I3 (in addition, input I3 is non-connection) and an output terminal Y denotes the multiplexer, wherein the S0 and S1 denote a control signal and I0 to I3 denote a signal to be selected.

The circuit of FIG. 13 outputs binary white noise having an absolute amplitude value equal to threshold value k and random characteristics when an absolute value of the amplitude of input signal x[n] exceeds threshold value k. Consequently, in the circuit of FIG. 13, the convergence of adaptive filter 107 is fast and howling is also quickly suppressed, as compared with the circuit of FIG. 14.

Figure 15A:
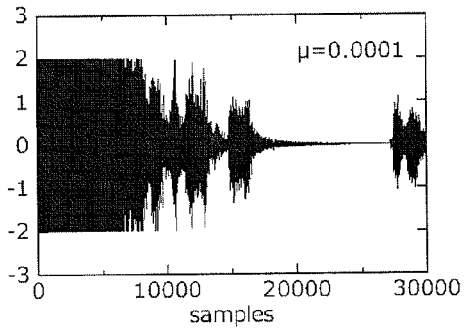
FIG. 15 is a diagram plotting an input signal of an adaptive filter, which is obtained by performing a simulation with respect to the circuit of FIG. 13 and the circuit of FIG. 14.
Figure 15B:
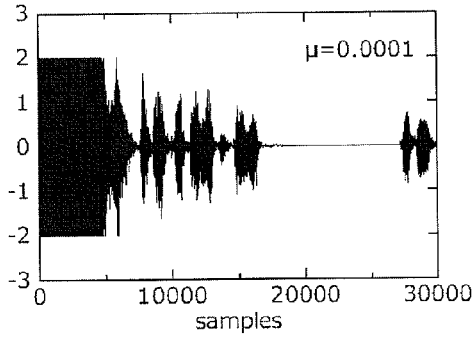

In order to verify the above-mentioned fact, a computer simulation of a howling canceller has been performed with respect to the case of using the simple circuit of FIG. 14 and the case of using the circuit of FIG. 13. FIG. 15 shows a simulation result and is a diagram plotting input signal x[n] of adaptive filter 107, which is obtained by the simulation. In FIG. 15, the horizontal axis denotes time (unit: sample) and the vertical axis denotes amplitude. FIG. 15A shows the case of using the circuit of FIG. 14 and FIG. 15B shows the case of using the circuit of FIG. 13.

In addition, in the computer simulation, as a speech signal to be input from microphone 104, a signal which is recorded at a sampling frequency of 8 kHz and has an absolute amplitude value normalized to be equal to or smaller than 1.

15A, the saturation of howling sound at the time of 8000 samples is made, but oscillating sound is continuously generated after that and howling is completely suppressed after the time of 20000 samples. Meanwhile, in FIG. 15B, howling is completely suppressed by the time of 8000 samples.

As described above, according to the present embodiment, when an absolute value of the amplitude of input signal x[n] exceeds threshold value k, since the output signal of the circuit becomes binary white noise, the convergence characteristics of adaptive filter 107 during the occurrence of howling can be improved and howling can be suppressed at a high speed.

(Embodiment 5)

In Embodiment 5, a case in which the amplitude of howling sound occurring in a start period is decreased to reduce discomfort of auditory sensation in a howling canceller using an adaptive filter will be described. In detail, in the present embodiment, threshold values K different in a start period and a normal operation state (after the start period) are used, and the initial values of the threshold values K are set as a small value as compared with the normal operation state and are increased in a continuous manner or a step-by-step manner.

Figure 16:
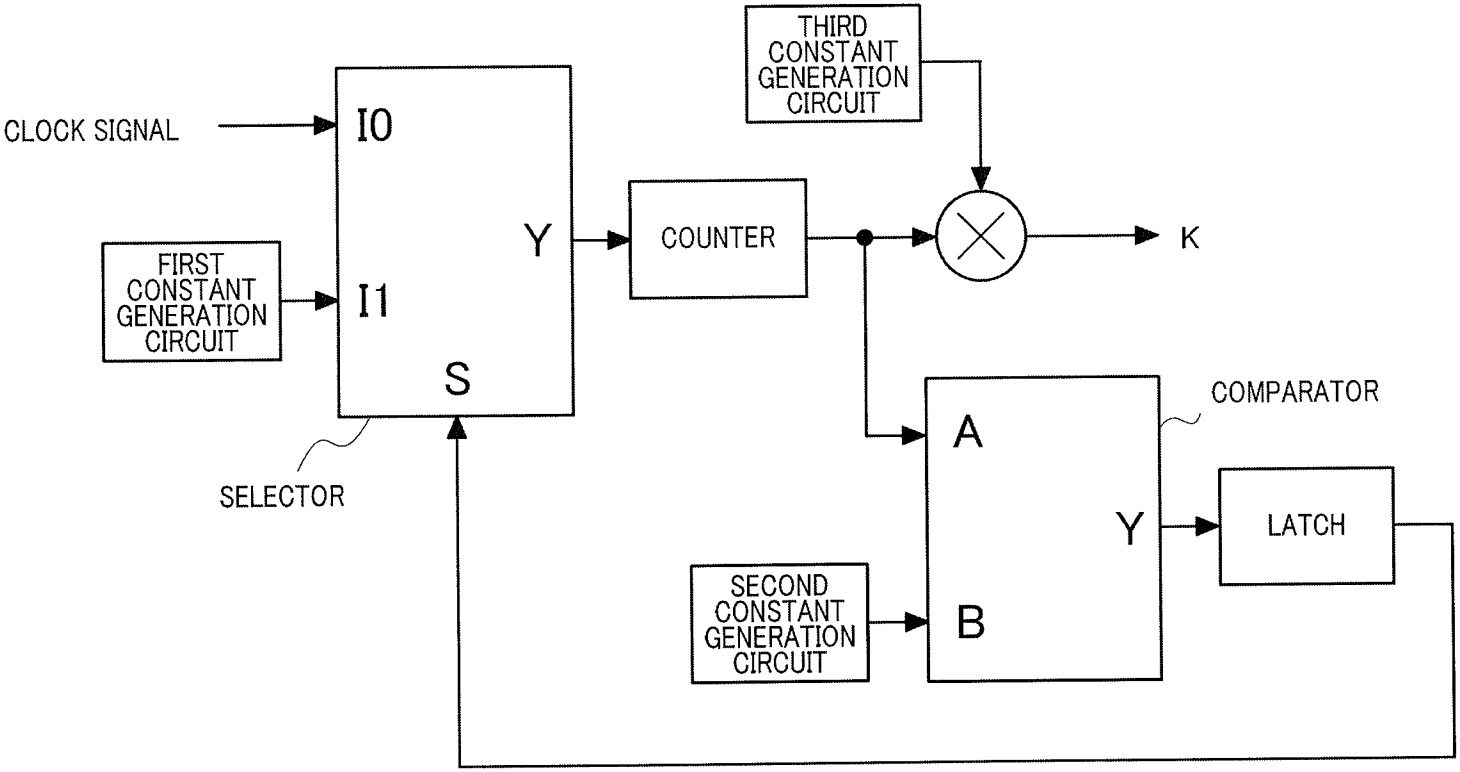
FIG. 16 is a diagram showing a circuit configuration of an amplitude limiting circuit of a howling canceller according to Embodiment 5 of the invention.

FIG. 16 is a diagram showing a circuit configuration of amplitude limiting circuit 110 according to the present embodiment. In FIG. 16, an initial value of a counter is 0 and an initial value of a latch is also 0. In this circuit, if a count value held in the counter is set as n and an output value of a third constant generation circuit is set as C, threshold value k is C·n.

The initial value "0" is held in the latch when the system starts operating, and a control signal S of a selector is "0." When the control signal S is "0," a clock signal is output from terminal Y of the selector. The counter is reset to the initial value 0 when the system starts operating, and then counts the number of input clock signals. If the value of the counter is equal to a value output from a second constant generation circuit, "1" is output from terminal Y of a comparator and a value "1" is held in the latch. As a consequence, the control signal S of the selector is "1," and a logic value "0" generated by a first constant generation circuit is permanently output from terminal Y of the selector. Thus, the counting operation of the counter is stopped.

Consequently, in the circuit of FIG. 16, threshold value k after the system starts operating is increased from "0," and is constant if a time determined by the second constant generation circuit is reached.

Figure 17:
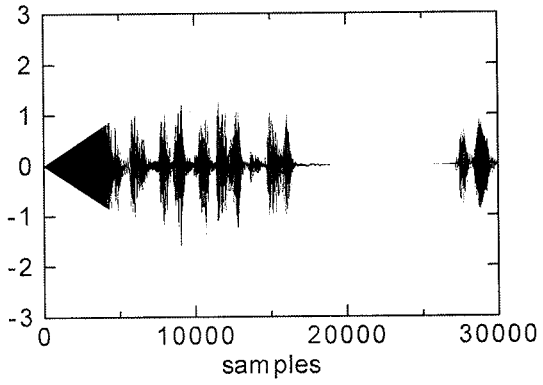
FIG. 17 is a diagram showing a simulation result when continuously controlling a threshold value with respect to the circuit of FIG. 16.

FIG. 17 is a diagram showing a simulation result according to the present embodiment when continuously controlling threshold value k, which is a diagram plotting input signal x[n]. In addition, in the present simulation, threshold value k of amplitude limiting circuit 110 is controlled as expressed by equation 13 below. In detail, threshold value k is controlled to be gradually increased from "0" in the range of n≤10000. In the range of 10000<n, threshold value k is controlled to be constant. In addition, the n of equation 13 denotes a variable in which a time is expressed in units of samples.

The process of equation 13 corresponds to the case in which an output value C of the third constant generation circuit is set to 0.0002 and an output value of the second constant generation circuit is set to 10000 in FIG. 16.

[13]

$$K = \begin{cases} 2 \cdot \dfrac{n}{10000} = 0.0002 \cdot n & (n \le 10000) \\ 2 & (10000 < n) \end{cases} \qquad \text{Equation 13}$$

As compared with the example of FIG. 15, in the example of FIG. 17, threshold value k is gradually increased from 0, so that the growth of howling sound having occurred at the time of start is gently suppressed to be small.

As described above, according to the present embodiment, threshold value k in the start period is set to be small as compared with the normal operation state and is increased in a continuous manner or a step-by-step manner, so that the growth of the amplitude of howling having occurred in the start period can be gently limited, thereby reducing user's discomfort.

( Embodiment 6)

In Embodiment 6, a case in which the amplitude of howling sound occurring in a start period is decreased to reduce discomfort of auditory sensation in a howling canceller using an adaptive filter will be described. In detail, in the present embodiment, an initial value k[0] of threshold value k[n] is set as a very small value, threshold value k[n] is exponentially increased at the time of start until threshold value k[n] is constant K, and a threshold value is set as constant K after threshold value k[n] reaches constant K. In addition, as described in Embodiment 1, constant K is a value for ensuring that all of D/A converter 101, power amplifier 102, speaker 103, microphone 104, microphone amplifier 105, and A/D converter 106 operate in the linear region without being saturated.

Figure 18:
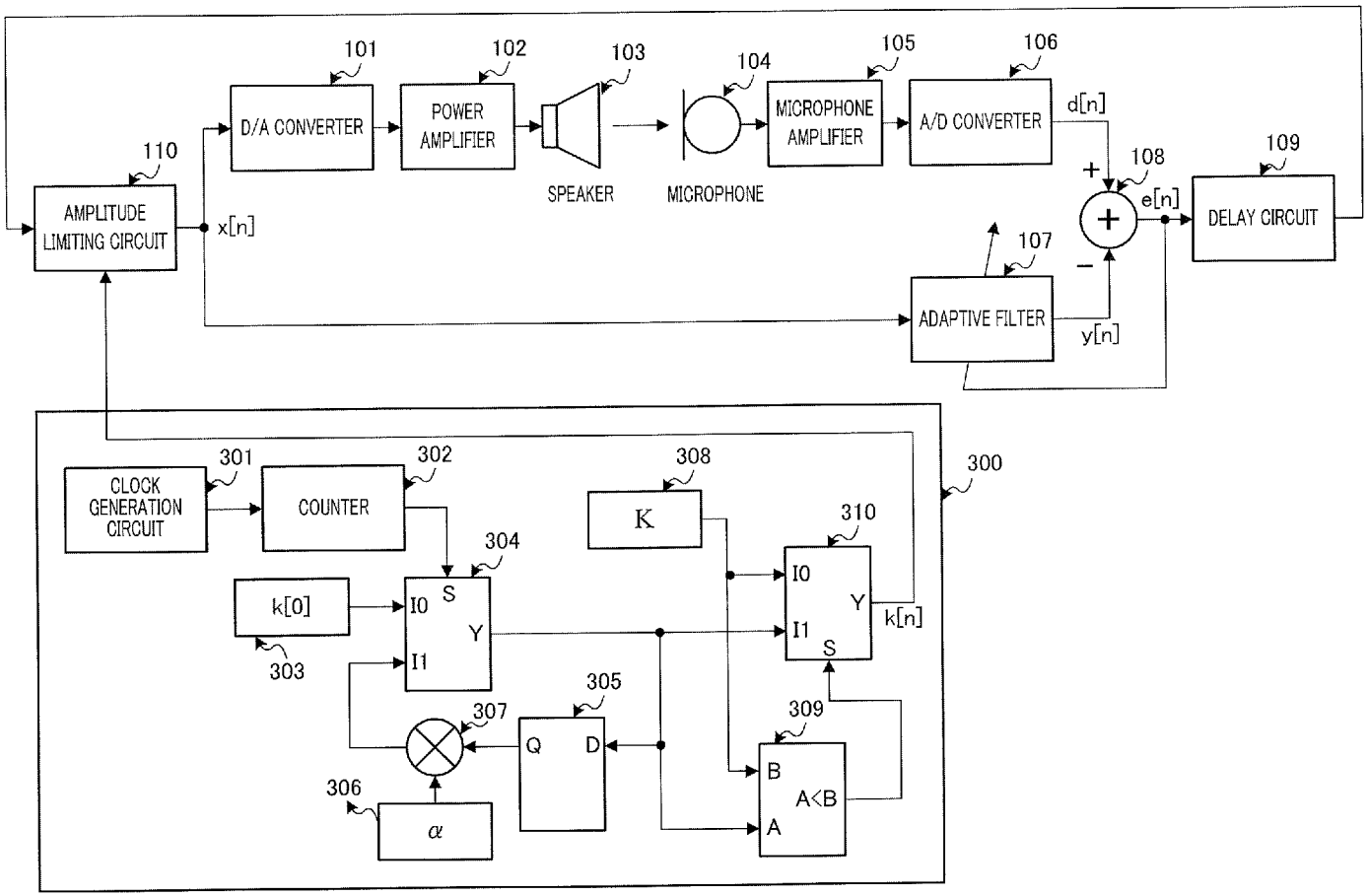
FIG. 18 is a block diagram showing a configuration of a loudspeaker having a howling canceller therein according to Embodiment 6 of the invention.

FIG. 18 is a block diagram showing a configuration of a loudspeaker having a howling canceller therein according to the present embodiment. FIG. 18 shows a configuration in which threshold value control circuit 300 is further added to the configuration of FIG. 1. Amplitude limiting circuit 110 limits the amplitude of input signal x[n] to be equal to or smaller than threshold value k[n], which has been set by threshold value control circuit 300.

As expressed by equation 14 below, threshold value control circuit 300 sets an initial value k[0] of threshold value k[n] as a very small value (about 0.001 to about 0.01), exponentially increases threshold value k[n] at the time of start until threshold value k[n] is constant K, and sets a threshold value as constant K after threshold value k[n] reaches constant K. In equation 14, α denotes a constant for controlling the degree of an increase of k[n], wherein 1<α.

[14]

$$k[n] = \begin{cases} \alpha \cdot k[n-1] & (\alpha \cdot k[n-1] < K) \\ K & (K \le \alpha \cdot k[n-1]) \end{cases} \qquad \text{Equation 14}$$

Threshold value control circuit 300 includes clock generation circuit 301, counter 302, constant generation circuit 303, selector 304, register 305, constant generation circuit 306, multiplier 307, constant generation circuit 308, magnitude comparator 309, and selector 310.

Clock generation circuit 301 generates a clock signal with a sampling frequency at which the entire system operates, and outputs the clock signal to counter 302.

Counter 302 is reset to an initial value 0 when the system starts operating and then counts the number of input clock signals. Then, counter 302 outputs a count value n of the clock signal to selector 304.

Constant generation circuit 303 generates the initial value k[0] of threshold value k[n].

Selector 304 selects a signal (an initial value k[0] of constant generation circuit 303) input to a terminal I0 thereof when a control signal S (=the count value n) is "0," and outputs the selected signal to register 305, magnitude comparator 309, and selector 310 from terminal Y thereof. Meanwhile, selector 304 selects a signal (the output of multiplier 307) input to terminal I1 thereof when the control signal S (=the count value n) is not "0," and outputs the selected signal to register 305, magnitude comparator 309, and selector 310 from terminal Y thereof.

Register 305 delays a signal (the output of selector 304), which is input to a terminal D thereof, by one sample, and outputs a delayed signal to multiplier 307 from a terminal Q thereof.

Constant generation circuit 306 generates constant α. Multiplier 307 multiplies the output of register 305 by constant α, and outputs a multiplication result to selector 304.

Constant generation circuit 308 generates constant K (the maximum value of threshold value k[n]).

Magnitude comparator 309 outputs "0" if a relationship in magnitude between an input signal (an output signal of selector 304) of terminal A thereof and an input signal (constant K) of terminal B thereof satisfies A≥B while outputting "1" if the magnitude relation satisfies A<B.

Selector 310 selects a signal (constant K) input to a terminal I0 thereof when a control signal S (an output signal of magnitude comparator 309) is "0," and outputs the selected signal to amplitude limiting circuit 110 from terminal Y thereof. Meanwhile, selector 310 selects a signal (the output signal of selector 304) input to terminal I1 thereof when the control signal S is "1," and outputs the selected signal to amplitude limiting circuit 110 from terminal Y thereof. The output signal of selector 310 is k[n] of equation 14 above.

Now, the operation sequence of threshold value control circuit 300 will be described.

At the time of start, since the count value n is 0, selector 304 outputs the initial value k[0] of threshold value k[n], which is input to the terminal I0 thereof, from terminal Y thereof. Since value k[0] is smaller than constant K, the output signal of magnitude comparator 309 is "1" and k[n] output from selector 310 is k[0].

Threshold value k[n] (=α×k[n−1]), which is obtained by an operation of register 305, constant generation circuit 306, and multiplier 307, is input to the terminal I1 of selector 304.

Then, if a clock signal is output from clock generation circuit 301, since the count value n is not 0, selector 304 outputs threshold value k[n] (=α×k[n−1]), which is input to the terminal I1 thereof, from terminal Y thereof.

When value k[n] is smaller than constant K, the output signal of magnitude comparator 309 is "1" and k[n] output from selector 310 is α×k[n−1]. That is, when value k[n] is smaller than constant K, it is exponentially increased.

Then, if value k[n] is equal to or higher than constant K, the output signal of magnitude comparator 309 is "0" and k[n] output from selector 310 is constant K.

As described above, according to the present embodiment, in the start period, the threshold value of amplitude limiting circuit 110 is exponentially increased from a very small value. In this way, the amplitude of howling sound having occurred once in the start period is suppressed to a small value according to threshold value k[n], and the convergence of an adaptive filter is made while the threshold value is very small and howling is suppressed, so that excessive howling sound is prevented from occurring.

In addition, in the start period, if threshold value k[n] is controlled to be increased, the above-mentioned effects can be achieved. However, threshold value k[n] is exponentially increased, so that it is possible to achieve an additional effect that a feeling of strangeness of a change in volume is reduced because a person feels that volume is very naturally linearly increased, due to auditory characteristics (Weber-Fechner law) of a person who feels that the magnitude of sound is proportional to a logarithm of sound pressure.

Figure 19:
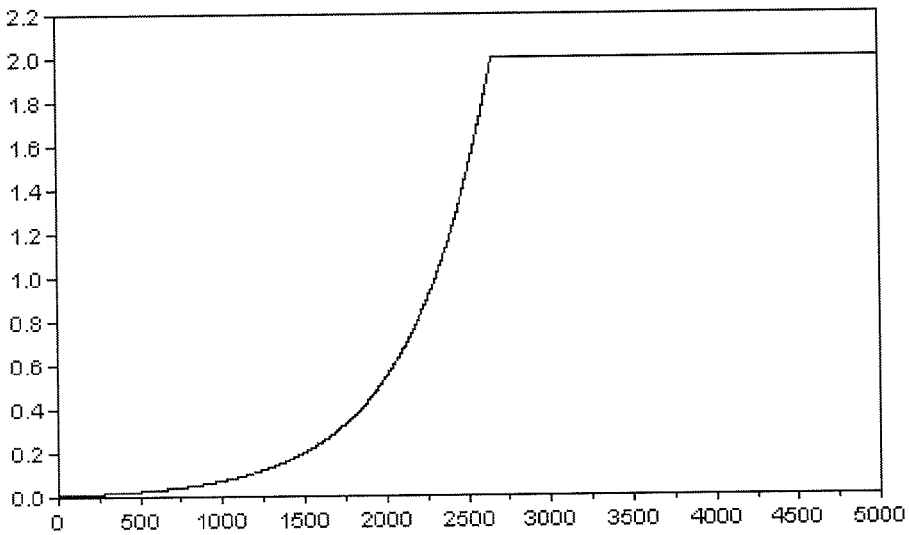
FIG. 19 is a diagram showing a change in threshold value k[n] when a value of a parameter is set in detail with respect to the circuit of FIG. 18.

FIG. 19 is a diagram showing a change in threshold value k[n] when a value of a parameter is set in detail with respect to the circuit of FIG. 18. In FIG. 19, the horizontal axis denotes time and the vertical axis denotes threshold value k[n]. In FIG. 19, K is set to 2, k[0] is set to 0.01, and a is set to 1.002. As is apparent from FIG. 19, threshold value k[n] is exponentially increased at the time of start, and is maintained as a constant value after reaching constant K (=2).

Figure 20A:
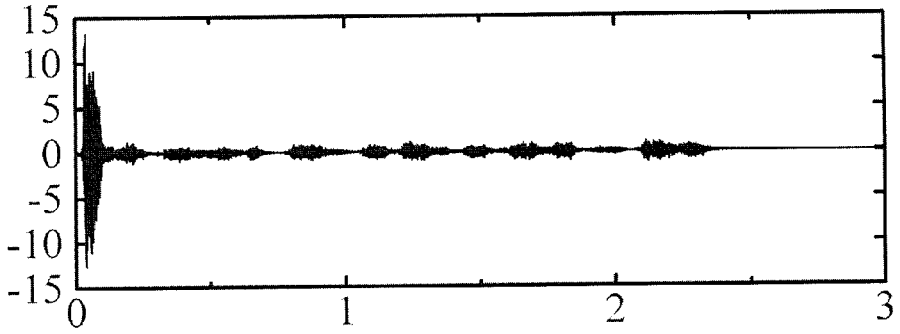
FIG. 20 is a diagram showing a waveform of an output signal (playback sound from a speaker) of a howling canceller.
Figure 20B:
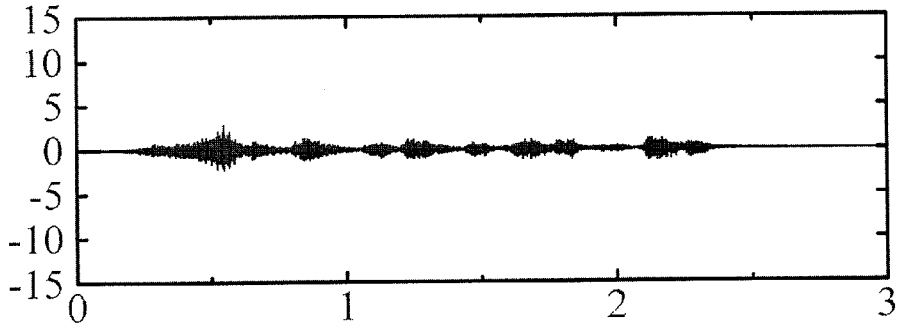

FIG. 20 is a diagram showing a waveform of an output signal (playback sound from a speaker) of a howling canceller. FIG. 20A shows the case in which threshold value k[n] is fixed to constant K at the time of start, and FIG. 20B shows the case in which the threshold value has been controlled as shown in FIG. 19.

As shown in FIG. 20A, if threshold value k[n] is fixed to constant K at the time of start, howling with a large amplitude occurs once in the start period.

Meanwhile, as shown in FIG. 20B, if threshold value k[n] is exponentially increased in the start period, since the amplitude of howling occurring in the start period is controlled at the same level as a speech signal after howling suppression, auditory discomfort of a person is significantly reduced.

So far, in the above-mentioned embodiments, the howling canceller of the loudspeaker system has been described. However, the present invention can also be applied to an echo canceller (a howling canceller) of a bi-directional communication system shown in FIG. 21. If the input and the output of the echo canceller of FIG. 21 are short-circuited to each other, the echo canceller has the same configuration as that of the howling canceller of the loudspeaker system of FIG. 1.

Figure 21:
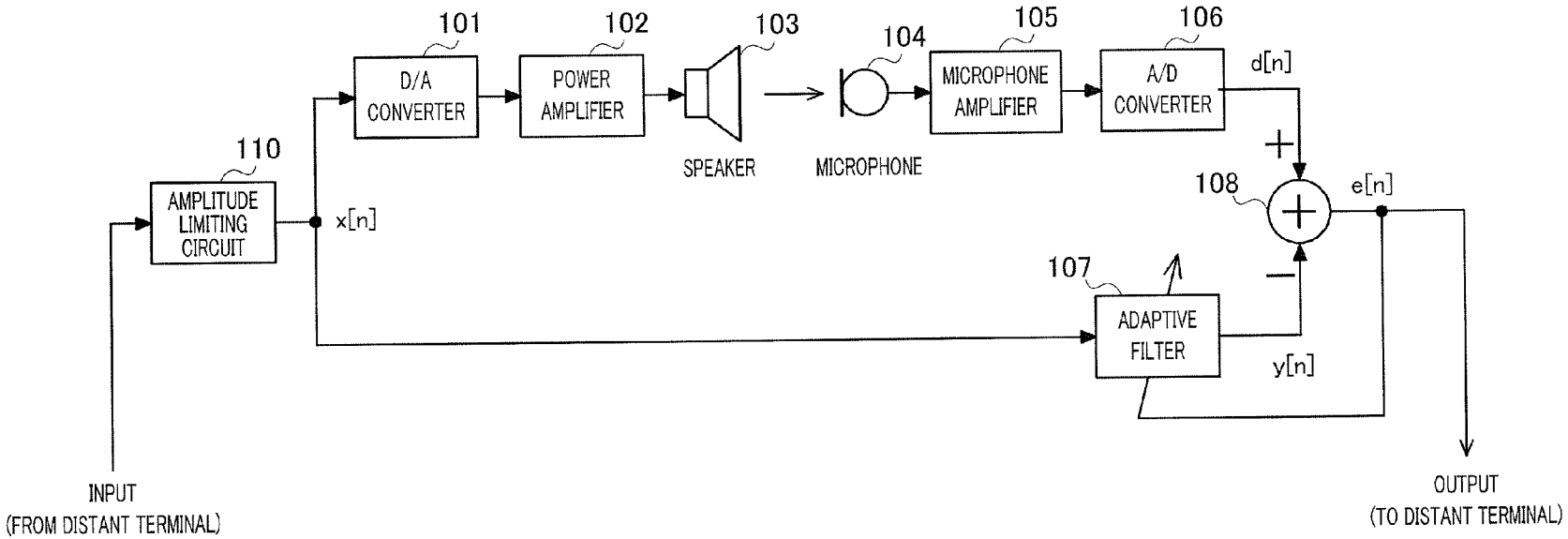
FIG. 21 is a block diagram showing a configuration of a communication apparatus when a howling canceller according to each Embodiment of the invention is applied to an echo canceller of a bi-directional communication system.

The purpose of adaptive filter 107 of FIG. 21 is to cancel echo first of all. However, if the present invention is employed, it is possible to obtain the function of a howling canceller that suppresses howling having occurred due to insufficient suppression of echo.

( Embodiment 7)

Embodiment 7 describes a method for removing processing delay while maintaining the quality of playback sound when the howling canceller of the present invention is applied to a hearing aid.

If processing delay (propagation delay) of the hearing aid is large, a user feels discomfort by a time lag between motion of the mouth of a communication partner and sound actually heard. In this regard, in the hearing aid, it is necessary to reduce the processing delay to the greatest extent possible.

However, when delay circuit 209 is simply removed from the loudspeaker shown in FIG. 1, abnormal noise is introduced to playback sound, resulting in the deterioration of sound quality. First, this problem will be described. The following description will be given on the assumption that adaptive filter 107 is completely converged and howling has been suppressed.

If the howling is suppressed, residual signal e[n] includes only a component of a speech signal s[n] input to microphone 104.

Residual signal e[n] is fed back to an input side of the system, and becomes input signal x[n] of adaptive filter 107 via amplitude limiting circuit 110.

Since arithmetic processing of a discrete time system is sequentially performed, input signal x[n] at the time n becomes residual signal e[n−1] at the time n−1 prior to one sample. That is, x[n]=e[n−1]=s[n−1].

Speech signal s[n] input to microphone 104 theoretically becomes additive noise added to an adaptive system with the same configuration as that of the system.

Thus, in the case of performing an arithmetic operation of adaptive filter 107 using input signal x[n]=s[n−1] at the time n, a signal component s[n]=x[n+1], which has a time difference corresponding to one sample, is input to the adaptive system via microphone 104 as additive noise.

That is, in the analysis based on the assumption that adaptive filter 107 converges, due to the presence of a feedback of a residual signal from the output side to the input side of the adaptive system, a signal component (hereinafter referred to as "correlation component"), which has a time difference corresponding to one sample with respect to a current signal and a large correlation with the current signal, is always introduced to the system as noise.

Furthermore, in the analysis based on the assumption that adaptive filter 107 is not converged, a noise component with a large correlation with the current signal circulates a closed signal path lots of times via a feedback path, thereby having an adverse influence on the convergence of adaptive filter 107.

Through the above analysis, it can be understood that it is difficult to achieve good convergence characteristics of the adaptive filter in a howling canceller in which additive noise corresponding to a correlation component exists.

Therefore, in the howling cancellers described in the above embodiments, if the delay circuit is simply removed, it is possible to suppress howling in a saturated state, but abnormal noise is introduced to playback sound due to the fluctuation of an adaptive filter coefficient, resulting in the deterioration of sound quality.

Present inventor(s) predicts a correlation component and reduces in advance a correlation component predicted from an input signal of an adaptive filter and a desired signal, together with correlation characteristics of sound itself, thereby recognizing that it is possible to improve the convergence characteristics of the adaptive filter and solve the above-mentioned problem.

Figure 22:
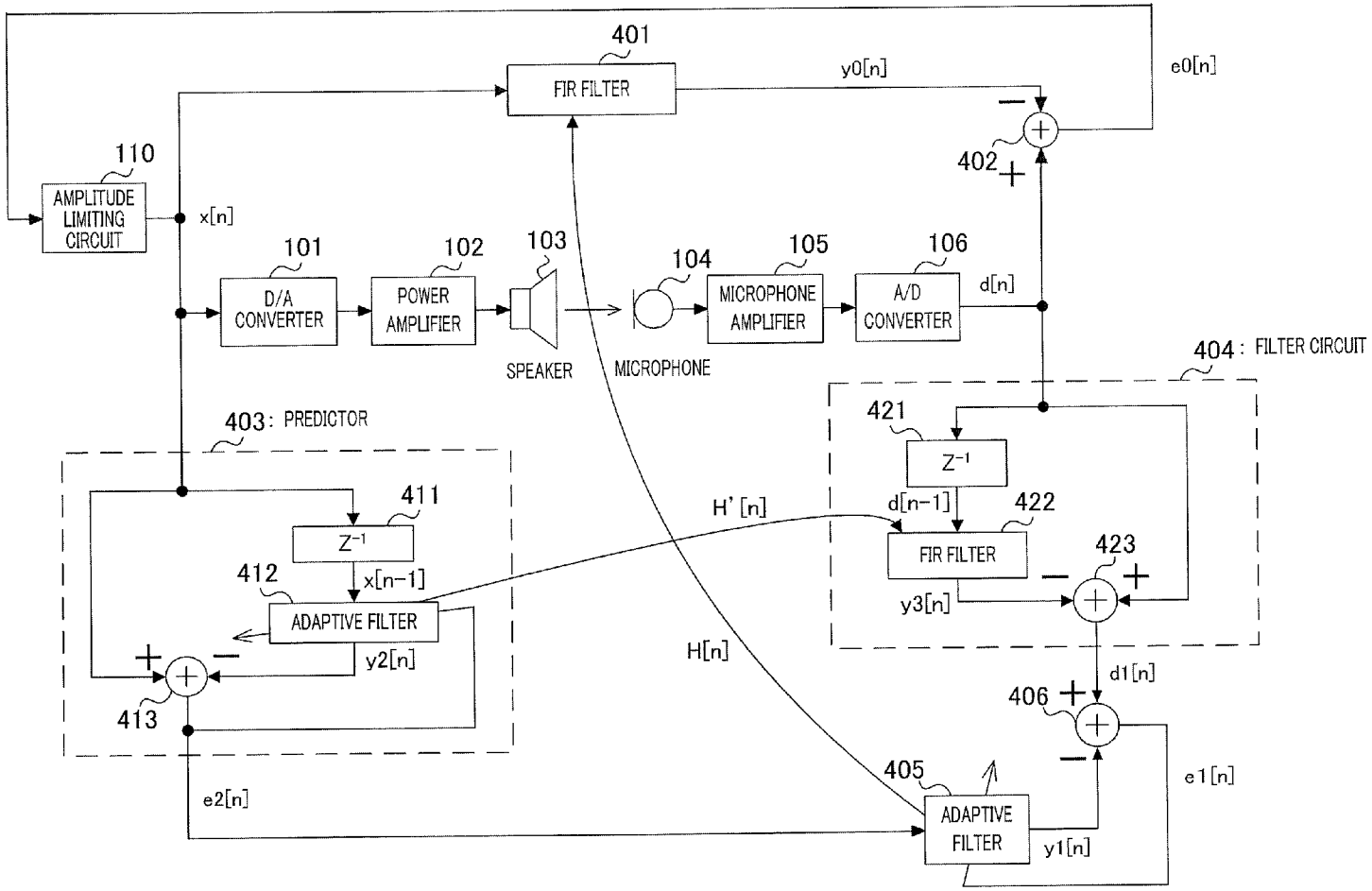
FIG. 22 is a block diagram showing a configuration of a hearing aid having a howling canceller therein according to Embodiment 7 of the invention.

FIG. 22 is a block diagram showing a configuration of a hearing aid having a howling canceller therein according to Embodiment 7 of the present invention. FIG. 22 shows a configuration in which adaptive filter 107, subtractor 108, and delay circuit 109 are removed, but FIR filter 401, subtractor 402, predictor 403, filter circuit 404, adaptive filter 405, and subtractor 406 are further added with respect to the configuration of FIG. 1.

FIR filter 401 operates input signal x[n] with tap coefficient H[n] to generate replica y0[n] of a playback sound component (a howling sound component/an echo component) output from speaker 103. Tap coefficient H[n] of FIR filter 401 is obtained by copying tap coefficient H[n] of adaptive filter 405. Furthermore, a tap length of FIR filter 401 is the same as adaptive filter 405.

Subtractor 402 subtracts the replica y0[n] of the playback sound component output from FIR filter 401 from speech signal d[n] output from A/D converter 106, thereby generating residual signal e0[n]. Residual signal e0[n] is obtained by removing a reinforced sound component played back by speaker 103 from signals input to microphone 104.

Predictor 403 predicts a correlation component of input signal x[n] and removes the correlation component from input signal x[n]. Predictor 403 includes delay circuit ($z^{-1}$) 411, adaptive filter 412, and subtractor 413.

Delay circuit 411 delays input signal x[n] by one sample to obtain input signal x[n−1].

Adaptive filter 412 operates input signal x[n−1] with tap coefficient H'[n] to generate prediction value (correlation component) y2[n] next to one sample. Furthermore, adaptive filter 412 updates tap coefficient H'[n] such that residual signal e2[n] output from subtractor 413 is an optimal value. In addition, adaptive filter 412 has a FIR configuration and uses existing LMS algorithm, projection algorithm, RLS algorithm and so forth as adaptive algorithm thereof. Even when the tap length of adaptive filter 412 is about 1 tap to about 3 taps, it is possible to sufficiently achieve the effects of the present invention.

Subtractor 413 subtracts prediction value y2[n] output from adaptive filter 412 from input signal x[n] to generate residual signal e2[n]. Residual signal e2[n], which is an output signal of predictor 403, is obtained by subtracting the correlation component from input signal x[n], and becomes an input signal of adaptive filter 405 of the next stage.

Filter circuit 404 removes the correlation component from speech signal d[n] output from A/D converter 106. Filter circuit 404 includes delay circuit ($z^{-1}$) 421, FIR filter 422, and subtractor 423.

Delay circuit 421 delays speech signal d[n] by one sample to obtain speech signal d[n−1].

FIR filter 422 operates to speech signal d[n−1] with tap coefficient H'[n] to generate prediction value y3[n] next to one sample. Tap coefficient H'[n] of FIR filter 422 is obtained by copying tap coefficient H'[n] of adaptive filter 412. Furthermore, a tap length of FIR filter 422 is the same as adaptive filter 412.

Subtractor 423 subtracts prediction value y3[n] output from FIR filter 422 from speech signal d[n] to generate a desired signal d1[n] of adaptive filter 405.

Adaptive filter 405 operates to residual signal e2[n] with tap coefficient H[n] to generate pseudo echo y1[n].

Subtractor 406 subtracts pseudo echo y1[n] from desired signal d1[n] of adaptive filter 405 to generate echo-suppressed residual signal e1[n].

If adaptive filter 405 converges and energy of residual signal e1[n] is minimum, since tap coefficient H[n] of adaptive filter 405 becomes an estimation value of impulse response of the acoustic system between speaker 103 and microphone 104, tap coefficient H[n] is copied to FIR filter 401 to perform a process of removing a howling component.

As described above, according to the present embodiment, a correlation component generated by additive noise to the system is predicted and removed from residual signal e2[n], which is the input signal of adaptive filter 405, and desired signal d1[n], so that adaptive filter 405 can perform a stable adaptive operation regardless of the influence of a noise component with a large correlation.

Consequently, in accordance with the howling canceller according to the present invention, the delay circuit is removed from the feedback path to realize low processing delay, and a filter operation is performed using a signal obtained by removing a predicted correlation component, thereby preventing the deterioration of the convergence characteristics of the adaptive filter due to the removal of the delay circuit and the generation of abnormal noise.

FIG. 23 shows a result of a simulation for checking the effectiveness of the howling canceller according to the present embodiment.

Figures 23A, 23B, 23C:
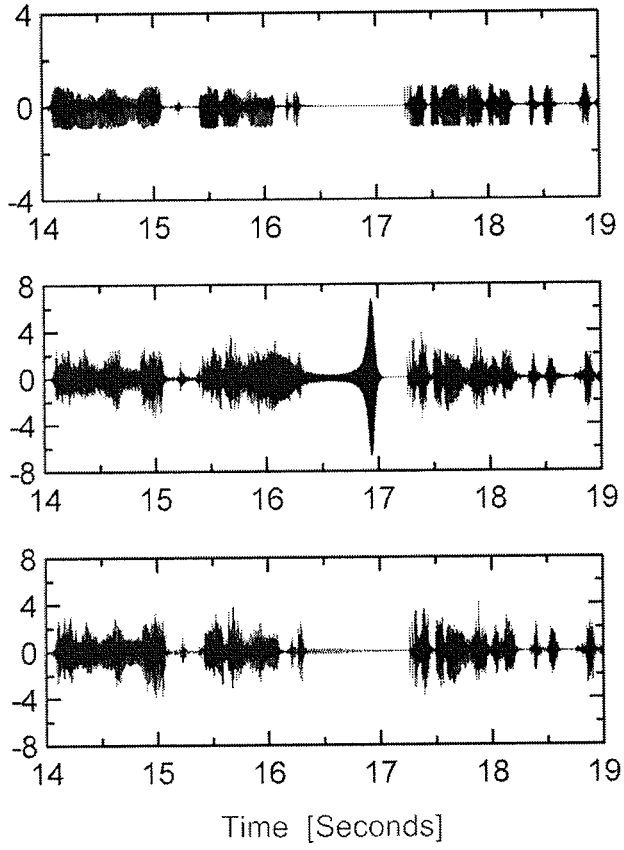
FIG. 23 is a diagram showing a result of a simulation for checking effectiveness of a howling canceller according to Embodiment 7 of the invention.

FIG. 23A shows the waveform of input sound to a microphone. FIG. 23B shows the waveform of playback sound emitted from a speaker after excluding a predictor and a filter circuit from the howling canceller of FIG. 22 and performing a simulation. FIG. 23C shows the waveform of playback sound emitted from the speaker after performing a simulation in the howling canceller of FIG. 22.

In FIG. 23B, although howling in a saturated state after having occurred at the time of start of the system is suppressed and 10 seconds or more pass, abnormal noise is generated in the playback sound from the speaker. However, in FIG. 23C, abnormal noise is not significantly generated. From these simulation results, it can be understood that the howling canceller of FIG. 22 stably operates.

In addition, in the howling canceller of FIG. 22, the frequency characteristics of residual signal e0[n] having no howling component is whitened with spectrum envelope characteristics input to microphone 104.

Since residual signal e0[n] is fed back to an input side of speaker 103 and played back from speaker 103, spectral characteristics of playback sound from speaker 103 have been whitened.

Since a long-term average spectrum of person's speech has high frequency drop characteristics, whitened playback sound output from speaker 103 has been subject to high frequency emphasis in terms of auditory sensation.

The high frequency emphasis can be reduced by adding a filter having high frequency drop characteristics equivalent to the average spectral characteristics of person's speech. When the filter having the high frequency drop characteristics is realized by a digital filter, the filter is inserted just prior to D/A converter 101. When the filter having the high frequency drop characteristics is realized by an analog filter, the filter is inserted immediately after D/A converter 101.

The disclosures of Japanese Patent Application No. 2009-068683, filed on Mar. 19, 2009, and Japanese Patent Application No. 2009-209298, filed on Sep. 10, 2009, including the specifications, drawings and abstracts, are incorporated herein by reference in their entirety.

INDUSTRIAL APPLICABILITY

The present invention is useful for a howling canceller of a loudspeaker, a howling canceller of a hearing aid, an echo canceller of a bi-directional communication system (a radio telephone, a wire telephone, an interphone, a TV conference system and so forth), and so forth.

REFERENCE SIGNS LIST

101 Digital-to-analog converter
102 Power amplifier
103 Speaker
104 Microphone
105 Microphone amplifier
106 Analog-to-digital converter
107, 405 Adaptive filter
108, 402, 406 Subtractor
109 Delay circuit
110 Amplitude limiting circuit
200 Threshold value setting circuit
300 Threshold value control circuit
401 FIR filter
403 Predictor
404 Filter circuit

The invention claimed is:

1. A howling canceller mounted in an apparatus including a digital-to-analog converter that converts a digital received speech signal into an analog received speech signal, a power amplifier that amplifies the analog received speech signal output from the digital-to-analog converter, a speaker that plays back the analog received speech signal amplified by the power amplifier and outputs sound, a microphone that converts sound including playback sound output from the speaker into an analog transmitted speech signal, a microphone amplifier that amplifies the analog transmitted speech signal output from the microphone, and an analog-to-digital converter that converts the analog transmitted speech signal amplified by the microphone amplifier into a digital transmitted speech signal, the howling canceller comprising:

an adaptive filter that operates the digital received speech signal with a tap coefficient to generate a pseudo echo, and updates the tap coefficient such that a residual signal is an optimal value;

a subtractor that subtracts the pseudo echo from the digital transmitted speech signal to generate the residual signal;

a delay circuit that connects to the subtractor and delays the residual signal output from the subtractor by a predetermined time;

a threshold value setting circuit that directly connects to the delay circuit and sets a threshold value based on a peak value of the delayed residual signal output from the delay circuit, and an amplitude limiting circuit includes circuitry that directly connects to the delay circuit and limits an absolute value of an amplitude of the delayed residual signal output from the delay circuit to be equal to or smaller than the threshold value set by the threshold value setting circuit, and outputs the amplitude-limited residual signal to the digital-to-analog converter and the adaptive filter as the digital speech signal, wherein the threshold value is a minimum value of a first threshold value set in a linear region of the digital-to-analog converter, a second threshold value set in a linear region of the power amplifier, a third threshold value set in a linear region of the speaker, a fourth threshold value set in a linear region of the microphone, a fifth threshold value set in a linear region of the microphone amplifier, and a sixth threshold value set in a linear region of the analog-to-digital converter to prevent howling.

2. The howling canceller according to claim 1, wherein the threshold value setting circuit comprises:

a section that detects the peak value of the digital received speech signal;

a section that determines whether to update the threshold value according to a relationship in magnitude between the peak value of the digital received speech signal and a value obtained by multiplying the threshold value by a first constant; and a section that updates a value obtained by multiplying the threshold value by a second constant as a new threshold value when updating the threshold value.

3. The howling canceller according to claim 1, wherein the threshold value setting circuit comprises:

an absolute value circuit that full-wave rectifies the digital received speech signal;

a low pass filter that detects the peak value of the digital received speech signal by smoothing output of the absolute value circuit;

a first multiplier that multiplies the threshold value by a first constant;

a magnitude comparator that determines a relationship in magnitude between the peak value of the digital received speech signal and a value obtained by multiplying the threshold value by a first constant;

a clock generation circuit that generates a clock signal when the peak value of the digital received speech signal is larger than the value obtained by multiplying the threshold value by the first constant;

a second multiplier that multiplies the threshold value by a second constant; and a register that holds an initial value of the threshold value, holds a value obtained by multiplying the threshold value by the second constant as a new threshold value when receiving the value obtained by multiplying the threshold value by the second constant, and outputs the held threshold value to the amplitude limiting circuit at a time of input of the clock signal.

4. The howling canceller according to claim 1, wherein, when the absolute value of the amplitude of the digital received speech signal exceeds the threshold value, the amplitude limiting circuit outputs binary white noise having an absolute amplitude value equal to the threshold value and a random code.

5. The howling canceller according to claim 1, wherein the amplitude limiting circuit sets an initial value of the threshold value to be smaller than a predetermined constant, and increases the threshold value in a continuous manner or a step-by-step manner until the threshold value reaches the predetermined constant.

6. The howling canceller according to claim 1, further comprising a threshold value control circuit that sets an initial value of the threshold value to be smaller than a predetermined constant, exponentially increases the threshold value from the initial value until the threshold value reaches the predetermined constant, and sets the threshold value as the constant after the threshold value reaches the constant, wherein the amplitude limiting circuit limits the absolute value of the amplitude of the digital received speech signal to be equal to or smaller than a threshold value controlled by the threshold value control circuit.

* * * * *